US012774838B2

(12) United States Patent
Rajendran et al.

(10) Patent No.: US 12,774,838 B2
(45) Date of Patent: Oct. 27, 2026

(54) METHOD OF FLOW CONTROL FOR LOW AMBIENT HEAT PUMP USING WET INJECTION CIRCUIT

(71) Applicant: Trane International Inc., Davidson, NC (US)

(72) Inventors: Muthukumaran Rajendran, Chennai (IN); Shriraj Nair, Bangalore (IN); Jayakrishnan K, Kovilpatti (IN); Brett R. Schneider, Tyler, TX (US); Don A. Schuster, Lindale, TX (US)

(73) Assignee: Trane International Inc., Davidson, NC (US)

( * ) Notice: Subject to any disclaimer, the term of this patent is extended or adjusted under 35 U.S.C. 154(b) by 173 days.

(21) Appl. No.: 18/659,290

(22) Filed: May 9, 2024

(65) Prior Publication Data

US 2025/0347454 A1 Nov. 13, 2025

(51) Int. Cl.
*F25B 49/02* (2006.01)
*F25B 5/02* (2006.01)
*F25B 41/20* (2021.01)

(52) U.S. Cl.
CPC ..... *F25B 49/02* (2013.01); *F25B 5/02* (2013.01); *F25B 41/20* (2021.01); *F25B 2400/0411* (2013.01)

(58) Field of Classification Search
CPC .. F25B 49/02; F25B 5/02; F25B 41/20; F25B 2400/0411; F25B 41/39; F25B 41/385; F25B 2700/2106
See application file for complete search history.

(56) References Cited

U.S. PATENT DOCUMENTS

| | | | |
|---|---|---|---|
| 3,423,013 | A | 1/1969 | Rinehart |
| 4,258,553 | A | 3/1981 | Kelly et al. |
| 4,458,502 | A | 7/1984 | Adachi et al. |
| 4,499,739 | A | 2/1985 | Matsuoka et al. |
| 4,551,983 | A | 11/1985 | Atsumi et al. |
| 6,330,805 | B1 | 12/2001 | Galian |
| 7,275,385 | B2 | 10/2007 | Abel et al. |
| 7,299,649 | B2 | 11/2007 | Healy et al. |

(Continued)

FOREIGN PATENT DOCUMENTS

| | | | | |
|---|---|---|---|---|
| CN | 100554820 C | * | 10/2009 | ..... F25B 40/00 |
| CN | 116907112 A | * | 10/2023 | ..... F25B 1/00 |

(Continued)

*Primary Examiner* — Kun Kai Ma
(74) *Attorney, Agent, or Firm* — Womble Bond Dickinson (US) LLP

(57) ABSTRACT

A method and apparatus for controlling a climate control system with a wet injection bypass line during heating mode for maintaining efficient operating temperatures and compressor ratio of a compressor at low ambient temperature. The process may include selectively routing a portion of a refrigerant through a wet-injection bypass line and controlling a flow rate of the portion of refrigerant flow through the wet-injection bypass line. Controlling the flow rate of the refrigerant flowing through the bypass line includes adjusting a valve or valves coupled the at least one wet-injection bypass line or multiple wet-injection bypass lines based on measured parameters of the refrigerant fluid, outdoor conditions, indoor conditions, and the operating map for the compressor.

20 Claims, 10 Drawing Sheets

(56) References Cited

U.S. PATENT DOCUMENTS

| | | | |
|---|---|---|---|
| 8,695,369 | B2 | 4/2014 | Wu et al. |
| 11,486,621 | B2 | 11/2022 | Shang et al. |
| 2020/0370808 | A1 | 11/2020 | Feng et al. |

FOREIGN PATENT DOCUMENTS

| | | | | | |
|---|---|---|---|---|---|
| GB | 1194006 | A | | 6/1970 | |
| GB | 2042150 | A | | 9/1980 | |
| GB | 2114724 | A | | 8/1983 | |
| GB | 2121942 | A | | 1/1984 | |
| GB | 2130747 | A | | 6/1984 | |
| GB | 2254135 | A | | 9/1992 | |
| GB | 2329237 | A | | 3/1999 | |
| JP | H07294052 | A | * | 11/1995 | |
| JP | H0821665 | A | * | 1/1996 | |
| JP | H09159288 | A | * | 6/1997 | |
| JP | 3719215 | B2 | * | 11/2005 | |
| JP | 2011179783 | A | * | 9/2011 | |
| JP | 2015087020 | A | * | 5/2015 | |
| KR | 20220050573 | A | * | 4/2022 | ..... F25B 49/022 |
| WO | 2006/045143 | A1 | | 5/2006 | |
| WO | WO-2018167866 | A1 | * | 9/2018 | ..... F25B 1/00 |

* cited by examiner

METHOD OF FLOW CONTROL FOR LOW AMBIENT HEAT PUMP USING WET INJECTION CIRCUIT

TECHNOLOGICAL FIELD

The present disclosure relates generally to improved systems and methods for a wet-injection bypass line within a heat pump climate control system, and it is particularly applicable for low temperature ambient conditions.

BACKGROUND

Various climate control systems exist, and several of these systems are able to provide both heating and cooling. These systems use refrigerant fluid circuits to transport thermal energy between components of the system. Each of these designs offer various advantages, and typically provide for conditioning over a given temperature range. A common form of these systems, often referred to as a heat pump, uses a reversible refrigerant fluid circuit that moves thermal energy between two or more heat exchangers to provide heating and/or cooling as desired.

Heat pumps are used in multiple different applications; however, challenges persist in transporting heat across large temperature gradients. For comfort conditioning this challenge often arises based on outdoor conditions where the temperature may be much higher (in cooling mode) than expected, or much lower (in heating mode) than expected. In particular, heat pumps often have issues in colder climates generating heat efficiently, effectively, and consistently.

In some applications, complex systems may be utilized that include components and controls; however, these solutions are not practical for most applications, and particularly not for many residential applications. Other applications address this issue through supplemental conditioning methods, e.g., supplemental heating; however, these solutions also present drawbacks such as inefficiencies, additional components, etc.

As a result, there exists a need to improve a heat pump's compressor efficiency while remaining cost effective in low ambient temperatures.

BRIEF SUMMARY

The present disclosure includes, without limitation, the following examples.

One embodiment is a method of controlling a wet-injection bypass line in a climate control system, the method comprising: circulating refrigerant fluid through a main refrigeration circuit to satisfy a conditioning load; selectively routing a portion of the refrigerant fluid through the wet-injection bypass line, the wet-injection bypass line routing the portion of the refrigerant from an upstream location on the main refrigerant circuit between an evaporator heat exchanger and a condensing heat exchanger to a downstream location on the main refrigerant circuit proximate a compressor inlet; controlling a flow rate of the portion of the refrigerant fluid through the wet-injection bypass line, wherein controlling the flow rate includes: determining a first parameter of the refrigerant fluid proximate the evaporator heat exchanger and a second parameter of the refrigerant fluid proximate the condensing heat exchanger, determining a compressor of the climate control system is operating outside an operating zone of the compressor for a period of time, determining an outdoor ambient temperature is below a temperature threshold, and adjusting a position of a valve coupled to the wet-injection bypass line in response to determining the period of time is over a threshold period of time and the outdoor ambient temperature is below the temperature threshold.

Another embodiment is a climate control system comprising: a main refrigeration circuit configured to circulate refrigerant fluid to satisfy a conditioning load; a wet-injection bypass line coupled to an upstream location on the main refrigerant circuit between an evaporator heat exchanger and a condensing heat exchanger and a downstream location on the main refrigerant circuit proximate a compressor inlet, the wet-injection bypass line configured to selectively route a portion of the refrigerant fluid from the main refrigeration circuit through the wet-injection bypass line, wherein the wet-injection bypass line includes a plurality of capillary tube circuits routed in parallel, each of the plurality of capillary tube circuits including a solenoid valve and a capillary tube; and a controller including a processor and a memory configured to store computer-readable program code including a control-related software application; and the processor configured to access the memory, and execute the computer-readable program code to cause the processor to at least: determine a first parameter of the refrigerant fluid proximate the evaporator heat exchanger and a second parameter of the refrigerant fluid proximate the condensing heat exchanger, determine a compressor of the climate control system is operating outside an operating zone of the compressor for a period of time, determine an outdoor ambient temperature is below a temperature threshold, and in response to determining the period of time is over a threshold period of time and the outdoor ambient temperature is below the temperature threshold, select at least one of the plurality of capillary tube circuits, and open the solenoid valve coupled to the selected at least one of the plurality of capillary tube circuits.

These and other features, aspects, and advantages of the disclosure will be apparent from a reading of the following detailed description together with the accompanying drawings, which are briefly described below. The disclosure includes any combination of two, three, four, or more of the above-noted embodiments, examples, or implementations as well as combinations of any two, three, four, or more features or elements set forth in this disclosure, regardless of whether such features or elements are expressly combined in a specific example description herein. This disclosure is intended to be read holistically such that any separable features or elements of the disclosed disclosure, in any of its various aspects, embodiments, examples, or implementations, should be viewed as intended to be combinable unless the context clearly dictates otherwise

BRIEF DESCRIPTION OF THE FIGURE(S)

Having thus described example implementations of the disclosure in general terms, reference will now be made to the accompanying figures, which are not necessarily drawn to scale, and wherein:

DETAILED DESCRIPTION

Figure 1A:
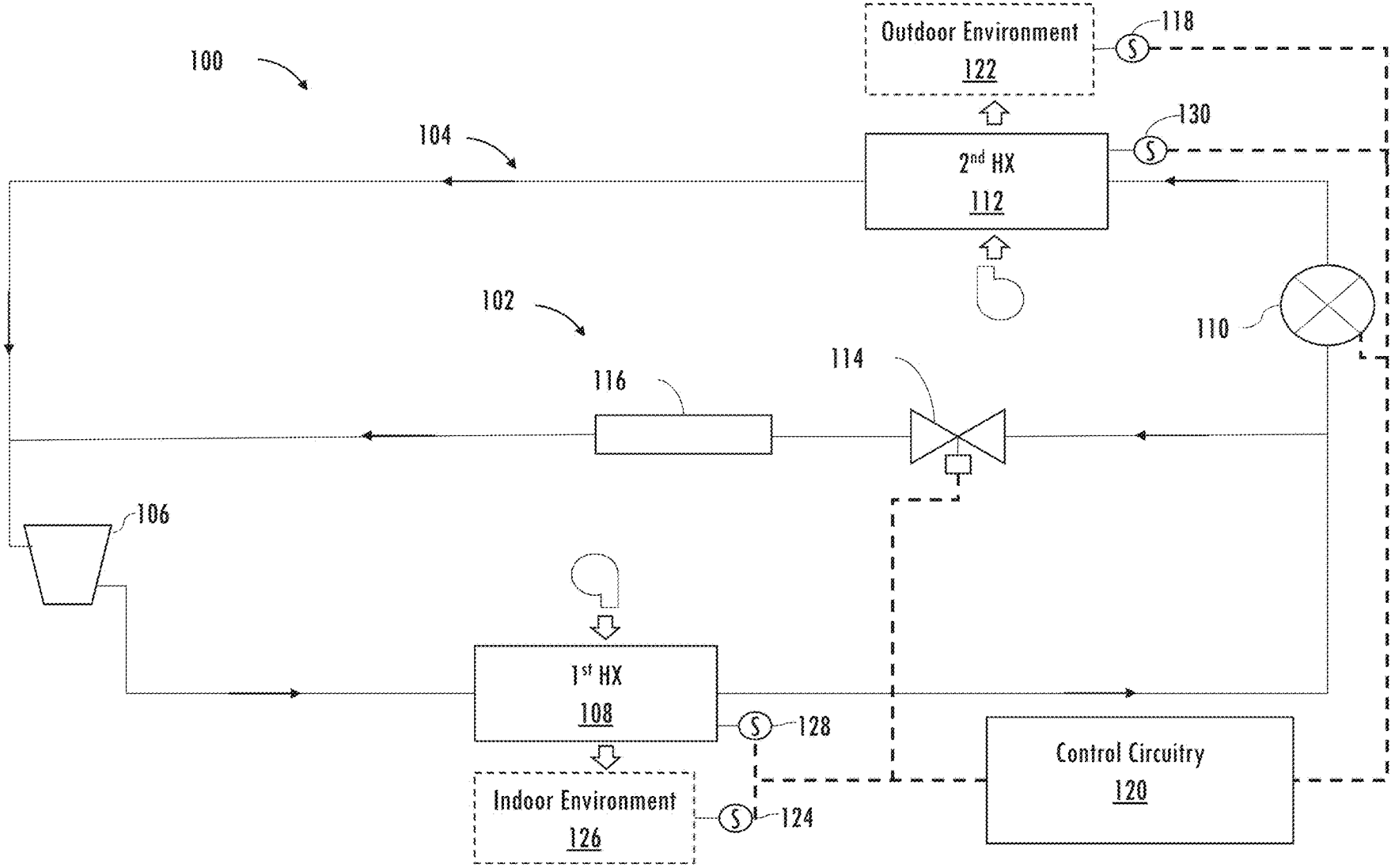
FIG. 1A is a schematic view of a climate control system according to some implementations.

Example implementations of the present disclosure provide a climate control system with an injection bypass line. This injection bypass line may be used to increase the operating range of the climate control system; however, in some circumstances the use of the injection bypass line may reduce overall performance. As a result, the flow of refrigerant through this bypass line is controlled based on multiple parameters to optimize the overall performance of the system while also extending the operating range for the system.

As described herein, this injection bypass line routes refrigerant from the main refrigerant circuit, allowing the refrigerant to bypass one or more of the components in the main refrigeration circuit. The portion of the refrigerant that is routed via the injection bypass line then is routed to the compressor, typically by rejoining the main refrigerant circuit downstream at a location proximate the inlet of the compressor. Typically, the bypass line is coupled to the main refrigerant circuit between the two heat exchangers, e.g., the condenser heat exchanger and the evaporator heat exchanger, and at that point the refrigerant is often a liquid (or predominately a liquid) in several climate control systems. As a result, the injection line, often is a wet-injection bypass line, and typically routes liquid refrigerant and allows that refrigerant to bypass the evaporator.

Utilizing the injection bypass line allows for improved performance only in certain circumstances. For example, diverting refrigerant from the evaporator results in less refrigerant being available to absorb heat at the evaporator; however, in some instances it may result in greater performance at the evaporator. For example, the bypass line may be used to subcool the refrigerant in the main line prior to entering the evaporator. Similarly, mixing refrigerant from the bypass line with refrigerant discharged from the evaporator may also have conflicting effects. As a result, the present disclosure utilizes various control processes to determine when to utilize the injection bypass line, and when used, to vary the flow rate of the refrigerant through the injection bypass line to optimize performance of the overall system and improve the overall life of the compressor, e.g., reduce compressor reliability risk.

For example, the disclosed process controls the flow rate of the portion of the refrigerant routed through the injection bypass line based on multiple parameters. For example, one of the parameters may be the saturation temperature at the evaporator, e.g., the evaporator saturation temperature, and another parameter may be the saturation temperature at the condenser, e.g., the condenser saturation temperature. Using these two parameters, it may be determined whether the compressor is operating within a desired operating zone. If it is not, and the compressor is operating outside of the operating zone for a set period of time, then that may indicate the injection bypass line should be utilized. In some examples, this indication alone is sufficient to initiate the flow of refrigerant through the injection bypass line. In other examples, additional conditions need to be meet. For example, the process may also determine that the outdoor ambient temperature is below a certain temperature threshold when the climate control system is operating in heating mode. If the outdoor temperature is sufficiently low, and the compressor is operating outside the compressor operating zone for a certain period of time, then the process may allow refrigerant to flow through the injection bypass line. Sill other examples are described herein.

Once the process determines that the injection bypass line should be utilized, the process adjusts the position of one or more valves to allow refrigerant to flow through the line. This may include opening a solenoid valve, and/or a more complex process such as adjusting the position of a modulating valve, etc. Still other processes may be utilized as discussed herein.

Further, the process may also provide more precise control of the flow rate through the injection bypass line, and in some examples, this may be performed by utilizing restrictions within the bypass line to allow only a certain amount of fluid to pass in a given time. For example, the injection bypass line may include a metering device, such as a capillary tube. This metering device may be used to depressurize the refrigerant flowing through the injection bypass line, which may allow it to vaporize when it merges with the refrigerant in the main refrigerant circuit. In addition to depressurizing the refrigerant, the metering device also restricts the flow of the refrigerant though the wet-injection bypass line which only causes a given fluid flow to enter the wet-injection bypass line. The amount of refrigerant can be adjusted by adjusting the metering device, e.g., different sizes of capillary tubes allow different refrigerant flows potentially at different pressures, etc.

In some examples, the wet-injection bypass line includes multiple capillary tube circuits in parallel. Each of these capillary tube circuits may include a solenoid valve and a capillary tube. Each capillary tube may be sized to allow a different refrigerant flow. In these examples, the process may use these different capillary tubes to adjust the fluid flow through the injection bypass line, e.g., by opening the solenoid valve coupled to the appropriately sized capillary tube. In other examples, the wet-injection bypass line includes an electronic expansion valve (EEV), and the process adjusts the position of the valve, which in turn adjusts the flow of refrigerant through wet-injection bypass circuit. It is understood that other metering devices may also be used in accordance with the disclosure herein.

The process may also use various conditions to determine the appropriate flow rate through the wet-injection bypass circuit. For example, the process may determine which capillary tube circuit(s) (or EEV position) is appropriate base on outdoor ambient temperature and the indoor temperature setpoint. These conditions may be indicative of the overall load the climate control system is addressing, which may also be indicative of the load of the compressor. Based on these conditions, the process may provide more or less refrigerant through the injection bypass circuit to improve the performance of the compressor, and thus the overall system.

Turning to the figures, the below walks through a more detailed discussion of the injection bypass line for use in a climate control system, which may utilize these control processes along with examples of each of the control processes. Before discussing the details of the process for adjusting the valve position in connection to the injection bypass line, an overview of an example embodiment of a climate control system with a wet-injection bypass line, and components thereof, is discussed with reference to FIGS. 1A-1C.

Figure 1B:
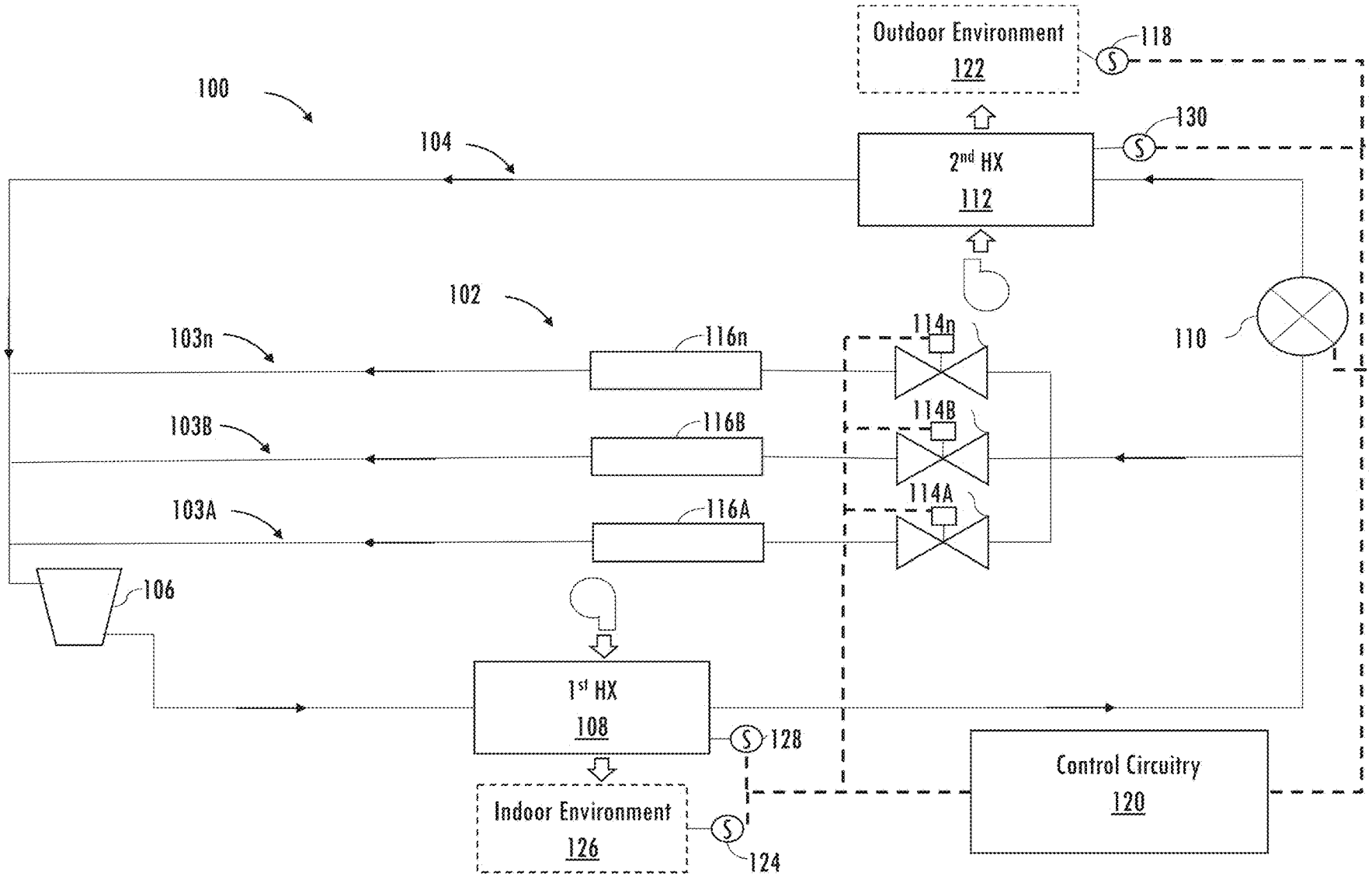
FIG. 1B is a schematic view of a climate control system according to some implementations.
Figure 1C:
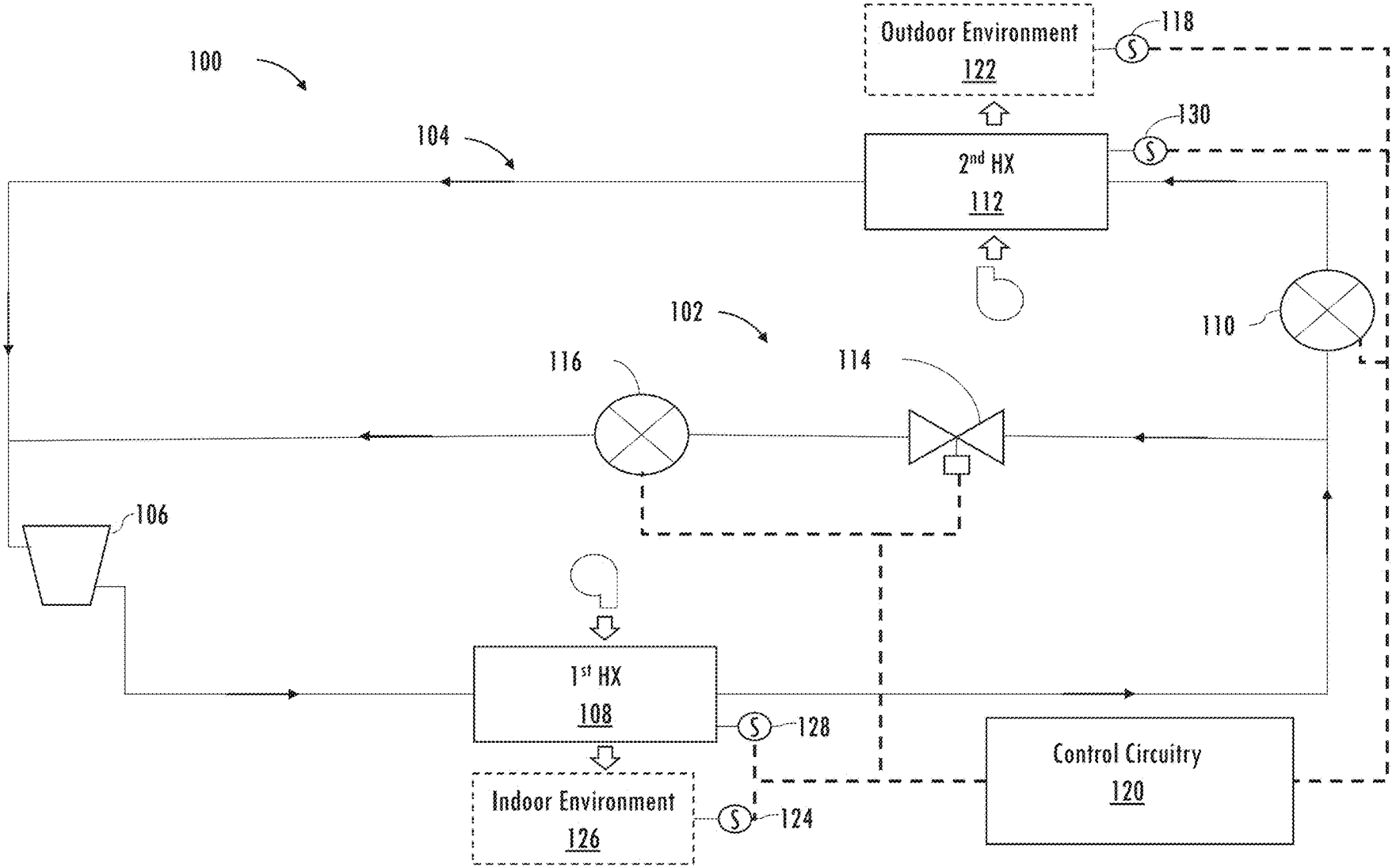
FIG. 1C is a schematic view of a climate control system according to some implementations.

FIGS. 1A-1C include a climate control system 100 with a wet-injection bypass line 102. In these examples, the climate control system 100 includes a main refrigerant circuit 104 which connects the various components directed to conditioning, e.g., compressor 106, a first heat exchanger 108, a metering device 110, and a second heat exchanger 112. The climate control system 100 further includes a wet-injection bypass line 102, which allows refrigerant to bypass the second heat exchanger 112. As discussed herein, utilizing this bypass circuit may improve the overall performance of the system, particularly when the system operates in heating mode and is subject to cold climate conditions.

To walk through the components in more detail, the main refrigerant circuit 104 may generally comprise standard conditioning equipment, an example of which is described in more detail below in connection with FIG. 7. For example, as shown in FIGS. 1A-1C, a main refrigeration circuit 104 operating in heating mode is shown; however, it is understood that this cycle may be reversible to also operating in cooling mode. Further, in the depicted example, the compressor 106 circulates refrigerant through the main refrigerant circuit 104 to the first heat exchanger 108, where heat is transferred from the refrigerant to a thermal transfer fluid (e.g., air) to condition a space, e.g., the indoor environment 126 in the depicted example. In the depicted example, the first heat exchanger 108 serves as a condensing heat exchanger. The refrigerant in the main refrigeration circuit 104 then continues to the metering device 110, which reduces the pressure of the refrigerant prior to entering the second heat exchanger 112. At the second heat exchanger 112, the refrigerant absorbs heat from an outdoor environment 122 and then returns to the compressor 106 to repeat the cycle. In the depicted example, the second heat exchanger 112 serves as an evaporating heat exchanger. Each of the components associated with the main refrigerant cycle may be the same or similar to the components discussed in connection with FIG. 7.

The bypass line 102 routes a portion of the refrigerant from the main refrigerant circuit 104 to bypass one or more components. As shown in FIGS. 1A-1C, the bypass line 102 couples to the main refrigerant circuit 104 between the first and the second heat exchangers (108 and 112). In the depicted example, the bypass line 102 routes this portion of the refrigerant to the suction side of the compressor 106, e.g., to the compressor inlet. In this example, the bypass line 102 allows the portion of the refrigerant to bypass the second heat exchanger 112 and associated components, returning to the main refrigerant circuit 104 proximate the inlet to the compressor 106. It is understood that the bypass line 102 may couple directly to the compressor inlet and/or at other locations, e.g., other points along the main refrigerant circuit.

Further, the bypass line 102 includes the bypass valve 114, and a bypass metering device 116. The bypass valve 114 may be used to control whether refrigerant enters the bypass line 102, and in some examples, it may also adjust or set the flow rate of the refrigerant through bypass line 102. The bypass metering device 116 may be used to depressurize the refrigerant through the bypass line 102, which may allow the liquid refrigerant routed through the bypass line 102 to vaporize once returning to the main refrigerant circuit 104. In some examples, the bypass metering device 116 may also assist in adjusting or setting the flow rate of the refrigerant through the bypass line 102. And in some examples, as discussed herein, a single device may serve as both the bypass valve 114 and the bypass metering device 116.

To walk through further examples, the bypass valve 114 may be a solenoid valve, which either allows or prevents the flow of refrigerant through the bypass line 102. In other examples, bypass valve 114 is a modulating valve, which includes multiple different position settings between fully open and fully closed. This modulating valve may be able to allow the flow of refrigerant through the bypass line 102, and it may also be able to set and adjust the flow rate of the refrigerant through the bypass line 102.

The bypass metering device 116 may be any standard device. For example, it may be a capillary tube, a thermostatic expansion valve, an orifice, an electronic expansion valve, or any other similar device. As discussed above, this device may be used to depressurize the refrigerant in the bypass line 102. Further, the bypass metering device 116 also restricts the flow of refrigerant through the bypass line 102. This restriction can also assist in controlling the flow rate of the refrigerant through the bypass circuit.

Various bypass lines 102 may be used in accordance with the examples described herein, and FIGS. 1B and 1C are used to provide two illustrative examples. In FIG. 1B, the climate control system 100 includes a bypass line 102 that utilizes a plurality of capillary tube circuits (103A-n). In the depicted example, the bypass line 102 includes three capillary tube circuits (103A-n) each including a bypass valve 114(A-n) and bypass metering device 116(A-n) respectively; however, it is understood that more or less of these capillary circuits may be used. In this example, each capillary tube circuit (103) includes a solenoid valve as the bypass valve 114 and a capillary tube as the bypass metering device 116.

Each capillary tube may be sized to address a given condition, and it may be optimized for that condition. For example, each capillary tube size may correspond to a given conditioning load, potentially a high-level load, and the capillary tube is design to provide the appropriate amount of refrigerant flow via the bypass line 102 at that load. In these examples, the conditioning load may correspond to outdoor ambient conditions and an indoor setpoint (potentially a temperature setpoint). As a result, when the process determines that the bypass circuit should be utilized, the process may also determine which capillary tube circuit (and corresponding capillary tube) should be opened based on which capillary tube has been optimized at that condition. In other examples, each capillary tube may be sized the same, and the system is able to adjust the refrigerant flow rate through the bypass line 102 by adjusting the number of capillary tube circuits that are opened. Further, it is understood that in some examples these techniques may be combined, e.g., including capillary tubes of different sizes and adjusting the number of capillary tubes that are opened, to control for even more flow rates through the bypass line 102.

FIG. 1C provides another example, and in that depicted example, an electronic expansion valve is used as the bypass metering device 116 in the bypass line 102. In this example, the bypass circuit also includes a modulating valve as the bypass valve 114. The modulating valve may be any type of modulating valve, and it may have a plurality of valve positions between a fully open and a fully closed position. It some examples, the valve positions may be continuously adjustable between fully open and a fully closed position. In the example depicted in FIG. 1C, the modulating valve is used to control the flow rate of refrigerant through the bypass line 102. The modulating valve may be used to control whether the bypass line 102 is utilized, either allowing or preventing refrigerant through the bypass line 102 similar to a solenoid. In addition, the modulating valve may also set or adjust the flow rate using the various valve positions.

Further, in the example depicted in FIG. 1C, the bypass line 102 includes an electronic expansion valve as the bypass metering device 116. In this example, the electronic expansion valve depressurizes the refrigerant flow directed through the bypass line 102 via the modulating valve. Because this flow rate may change, the electronic expansion valve may adjust to account for the differing refrigerant flow (or other factors). In some examples, the electronic expansion valve is used to both control the flow rate through the bypass line 102 and depressurize the refrigerant prior to returning to the main circuit proximate the inlet to the compressor, e.g., an electronic expansion valve serves as both the bypass valve 114 and the metering device 116. In these examples, the electronic expansion valve may be controlled to both open when conditions indicate that the bypass circuit should be utilized, and also open to the correct position to optimize the compressor performance.

Again, FIGS. 1B and 1C only provide two illustrative examples of bypass lines 102 according to the present disclosure. Other components may be utilized along with differing configurations in accordance with the teachings of this disclosure.

The examples depicted in FIGS. 1A-C also include various sensors and control circuitry. It is understood that more or less sensors may be included in accordance with the examples described herein. In the depicted examples, the climate control system 100 includes an outdoor sensor 118 which monitors the conditions of the outdoor ambient environment 122. In some examples, outdoor sensor 118 may be a temperature sensor to measure the temperature of the outdoor ambient temperature. Other sensors, such as pressure, humidity, etc. may also be included, and in some examples multiple sensors are utilized. The outdoor sensor 118, or the like, may transmit one or more signals representing the sensed condition, or the like, to at least the control circuitry 120. In some examples, the control circuitry 120 may cause the outdoor sensor 118, or the like, to record and/or transmit one or more signals representative of a temperature and/or other conditions. In some examples, the signal representing the ambient outdoor temperature may be received from an alternative source, such as available local weather data.

Climate control system 100 also includes an indoor sensor 124, and in this example indoor sensors 124 monitors the conditions associated with the indoor environment 126, e.g., a conditioned space. For example, indoor sensor 124 may be a temperature sensor, potentially included as part of a thermostat, and used to measure the temperature associated with the indoor environment. The indoor sensor 124, or the like, may monitor an indoor temperature and/or other conditions of an indoor environment 126, e.g., humidity, or the like, and more than one sensor may be utilized. In some examples, the indoor sensor 124, or the like, may transmit one or more signals representing sensed conditions, or the like, to at least the control circuitry 120. In some examples, the control circuitry 120 may cause the indoor sensor 124, or the like, to record and/or transmit one or more signals representative of a temperature and/or other conditions, e.g., of an indoor environment 126.

As shown, the climate control system 100 also includes a first sensor 128 and a second sensor 130 located in or at the first heat exchanger 108 and second heat exchanger 112, respectively. In some examples, these sensors assist in measuring a saturation temperature of each heat exchanger. For example, the first sensor 128 may monitor the temperature and/or pressure of the refrigerant flowing through the first heat exchanger 108, or in some examples, the first sensor 128 monitors the temperature and/or pressure of the refrigerant flowing at the discharge of the first heat exchanger 108. As discussed in more detail below, these temperature and/or pressure values may be used to determine the saturation temperature of the refrigerant at the first heat exchanger 108. Similarly, the second sensor 130 may monitor the temperature and/or pressure of the refrigerant flowing through the second heat exchanger 112 (or at the discharge thereof). It is understood that multiple sensors may be used to monitor the condition of the first heat exchanger 108 and the second heat exchanger 112, respectively. Further, it is understood that in some examples these sensors may be located away from the first and second heat exchangers respectively. For example, sensors may be located along the main refrigerant circuit monitoring the refrigerant discharged from the first heat exchanger 108 and that may be indicative of the conditions, e.g., saturation temperature, of the first heat exchanger. And similarly, sensors located along the main refrigerant circuit monitoring the refrigerant discharged from the second heat exchanger 112 may be indicative of the conditions, e.g., saturation temperature, of the second heat exchanger 112.

The climate control system also includes control circuitry 120, which may comprise in whole or in part the control circuitry 800 described in further detail below with respect to at least FIG. 8. In some examples, the control circuitry 120 may comprise one or more of a thermostat, a system controller, an indoor controller, an outdoor controller, or the like, as described in further detail below. The control circuitry 120 may comprise one or more controller algorithms including monitoring and/or controlling the climate control system 100. Further, the control circuitry 120 may be communicatively coupled at least, in part, to the compressor 106, the plurality of sensors 130, 128, 118, and 124, the outdoor metering device 110, and the bypass valve 114. In some examples, the control circuitry 120 may transmit one or more command signals to control at least, in part, the operation of at least the compressor 106, the plurality of sensors 130, 128, 118, and 124, the outdoor metering device 110, the bypass valve 114, one or more electronic expansion valves, etc., For example, the control circuitry 120 may transmit a command signal to the compressor 106 to increase speed and/or another command signal to one or more metering devices or valves to adjust position. Additionally, the control circuitry 120 may transmit a command signal to one or more sensors of the plurality of sensors 130, 128, 118, and 124 to record and/or transmit a measurement signal in response to the change in operation of the compressor 106 and/or a metering or valve device. In some examples, the control circuitry 120 may receive one or more signals representative of an operating condition, at least in part, of the operation of the compressor 106, the plurality of sensors 130, 128, 118, and 124, the outdoor metering device 110, and/or the like. Example operating conditions may include one or more of a speed, a position, a temperature, a pressure, a humidity, a refrigerant fluid charge level, a refrigerant fluid type, and/or the like as described by the present disclosure.

In some examples, the control circuitry 120 may perform one or more determinations, calculations, comparisons, and/or the like based at least, in part, on one or more received signals as will be described in further detail below. For example, the control circuitry 120 may adjust a position of the bypass valve 114 based, at least in part, on a measurement signal from the plurality of sensors 130, 128, 118, and 124 and a compressor operating map stored on the control circuitry 120.

Figure 2:
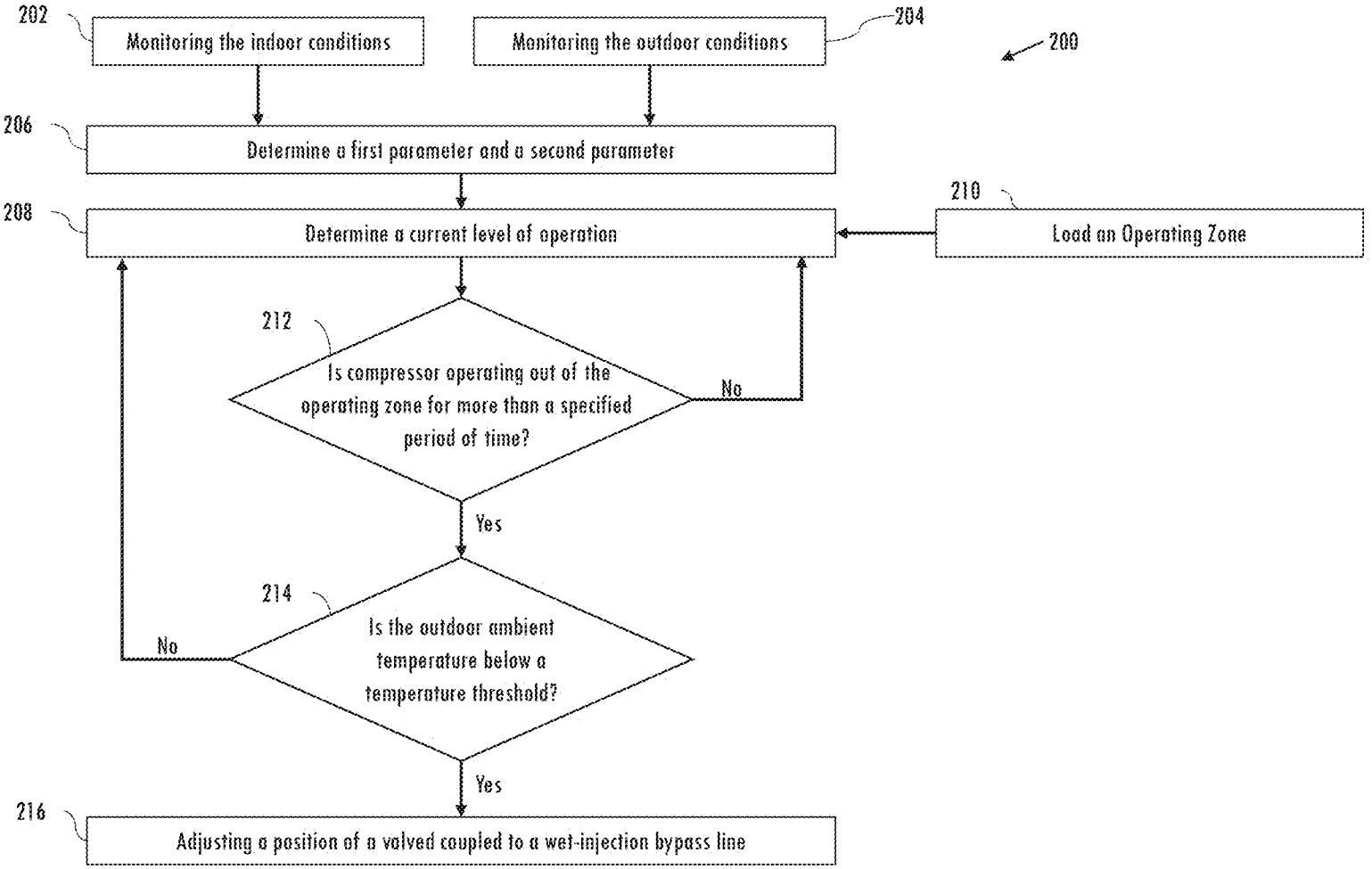
FIG. 2 is a flow chart illustrating various steps of adjusting a bypass valve(s) of a climate control system, according to various example implementations.

FIG. 2 shows a flow diagram of an example process 200 that may be utilized to determine when to allow refrigerant fluid through the bypass line 102. This may include determining conditions at which utilizing the bypass circuitry improves the overall performance of the climate control system 100. The process 200 may be carried out, at least partially, by one or more apparatuses, components, circuits, and/or the like according to some examples of the present disclosure. In some examples, the process 200 may be performed by a least the control circuitry, e.g., 120, 800, or the like. In some examples, the process 200 may be performed by two or more control circuits that are, at least in part, communicatively coupled together, e.g., a system controller, outdoor controller, indoor controller, or the like. In some examples, the process 200 may, at least in part, be included in the control circuitry 120, e.g., as a controller algorithm, executable program code, or the like, and may be stored on the control circuitry 120 of a climate control system 100 as described above.

Moreover, the process 200 as illustrated may be an at least partially closed loop process; however, in some examples other operations and processes as described herein may be incorporated, at least in part, into process 200. Some such examples will be described in further detail below with respect to FIG. 3.

Turning to FIG. 2, the process 200 includes determining indoor conditions at step 202, and the outdoor conditions at step 204. The process 200 further includes determining a first parameter and a second parameter at step 206. As discussed in more detail below, the first parameter may be the saturation temperature at the first heat exchanger, e.g., the condenser, and the second parameter may be the saturation temperature at the second heat exchanger, e.g., the evaporator. The process 200 continues to determine the current operating level of the compressor at step 208. In some examples, the current operating level is determined based on the first and second parameter. The process also includes loading an operating zone as shown in step 210. This may include loading the operating zone map into a memory of one or more controllers running process 200.

The process 200 continues to step 212 and step 214, which are used to determine if it is appropriate to utilize the bypass circuit. In the depicted example, these steps are shown sequentially with step 212 happening before step 214; however, it is understood that these steps may happen in reverse or in parallel. Further is it understood that in some examples only one of these steps may be utilized.

Further, at step 212, the process 200 may determine if the compressor is operating outside the operating zone. At this step 212 the process 200 may also determine whether the compressor is operating outside the operating zone for more than a specified period of time. If not, the process 200 may take no action with respect to the bypass circuit. However, if so, the process 200 may either take action or continue to assess whether the bypass circuit should be utilized. In the depicted example, if the compressor is operating outside the operating zone for a more than a specified period of time then the process 200 continues to step 214.

At step 214, the process 200 determines whether the outdoor ambient temperature is below a temperature threshold. If not, the process 200 may take no action with respect to the bypass circuit. However, if so, the process 200 may either take action or continue to assess whether the bypass circuit should be utilized. In the depicted example, if both step 214 and step 212 indicate the bypass circuit should be utilized, the process 200 continues to step 216.

At step 216, the process adjusts a position of a valve coupled to the wet-injection bypass line. In this example, it includes opening one or more valves, potentially the bypass valve 114, to allow refrigerant to flow through bypass circuit. As discussed in more detail below, more complex valve adjustments may also be utilized in certain circumstances.

To walk through each of these steps in more detail. Steps 202 and 204 are each directed to monitoring conditions. Step 202 is directed to monitoring the indoor conditions. This includes monitoring the temperature of the indoor space and potentially other conditions such as humidity, etc. This may also include monitoring the setpoint, e.g., the temperature and/or humidity setpoint of a given indoor space. This monitoring may be performed using a sensor, potentially a temperature sensor located within the space, e.g., within a thermostat, or through another method. In some examples, monitoring the indoor conditions allows for general feedback on the desired conditions, the overall performance and/or operating of the system. For example, if indoor conditions are not able to achieve a user setpoint despite various controls and adjustments than that may indicate the climate control system includes one or more faults. In these instances, the system may shut down and/or issue an alert. In some examples, it may be incorporated into the below process, potentially being an additional indicator that the bypass line should (or should not) be utilized. Further, in some examples, certain indoor conditions, e.g., setpoint, may be used as part of the process to determine when and/or how much refrigerant fluid should flow through the bypass circuit.

Similarly, at step 204 the conditions of the outside ambient environment are monitored. This includes monitoring the temperature of the outdoor environment and potentially other conditions such as humidity, etc. This monitoring may be performed using a sensor, potentially a temperature sensor located on an outdoor unit of a split system, or through another method. For example, outdoor conditions may be monitored by receiving data from available sources, such as internet sources.

As show in operation 206, the process 200 includes determining a first and a second parameter. For example, a first and second parameter of the refrigerant fluid at separate points in the climate control system. This first and second parameter may be the saturation temperatures of the first heat exchanger and the second heat exchanger, respectively. In some examples, the operation 206 may include measuring one or more refrigerant fluid parameter signals, from one or more sensors, representative of a refrigerant fluid parameter proximate a heat exchanger of the climate control system. In some examples, the first and second parameters are received via one or more of the sensors discussed above in connection with FIG. 1. Further, the first and second parameters measured from the first sensor and second sensor may be temperature, or pressure measures converted to a saturation temperature, using a pressure-temperature chart loaded to the control circuitry, of the first and/or second heat exchanger, or through a different process.

At step 208, the process 200 determines the operating level of the compressor. The compressor operating level may be determined at step 208 using the first and second parameters, e.g., the saturation temperatures at the first and second heat exchangers respectively. These parameters may be indicative of whether the compressor is operating at a desired level or not. In some examples, these may provide an indication of the compressor's operating speed, power draw, or other conditions.

At step 210, the process 200 includes loading a compressor operating zone. This step includes loading a compressor operating map into a memory associated with the climate control system, and it may be performed by any method. Further, the compressor operating zone may provide a map of operating levels that are acceptable or unacceptable. For example, FIG. 3 shows an example of a compressor operating map 300 that may be utilized.

Figure 3:
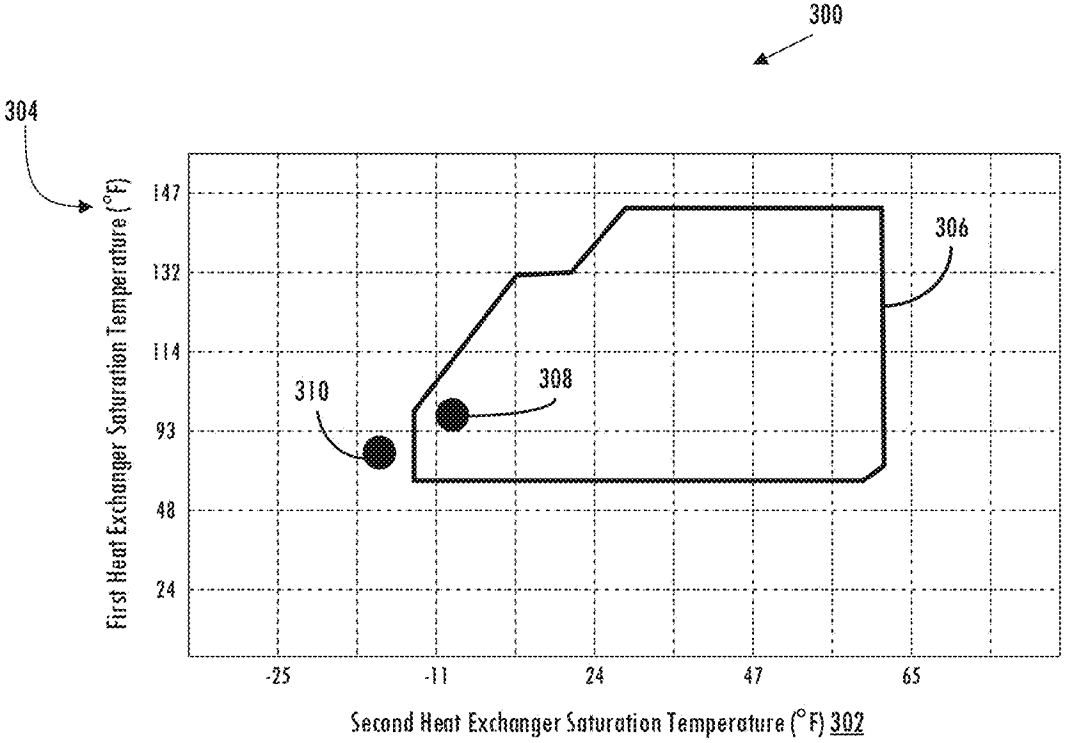
FIG. 3 illustrates a compressor operating map, according to some example implementations of the present disclosure.

In the example depicted in FIG. 3, the compressor map 300 includes an x-axis 302 that uses the second heat exchanger saturation temperature, and a y-axis 304 that uses the first heat exchanger saturation temperature. Using these parameters, the compressor operating levels are plotted. In addition, the compressor map 300 also includes an operating zone 306 to indicate which operating levels are acceptable and/or expected for the compressor, and which operating levels are unacceptable and/or could damage the compressor. In the depicted example, operating levels within operating zone 306 are considered acceptable, and those outside operating zone 306 are considered unacceptable. For example, in the depicted example, operating level 308 is within the operating zone 306 and allows for acceptable compressor operation; however, operating level 310 is outside the operating zone 306, and thus is an operating level that may harm the compressor.

Further, Applicant notes that the use of the wet-injection bypass circuit may alter the operating level, and thus change the operating level of the compressor from an unacceptable level to an acceptable level. For example, under certain conditions, e.g., outdoor ambient temperature and indoor setpoint, the climate control system may operate the compressor at operating level 310, which is an unacceptable level, when the bypass circuit is not being utilized. Under these same conditions, utilizing the wet-injection bypass circuit may adjust the first and second parameters and cause the compressor to operate at operating level 308, which is at an acceptable level.

Returning to process 200 and FIG. 2, once the current operating level has been determined at step 208, the process continues to determine if the bypass circuit should be utilized at steps 212 and 214.

At step 212, the process determines whether the compressor is operating outside the compressor zone, and if so, whether this unacceptable operation has lasted a period of time, e.g., equal to or greater than a given time. In some examples, this determination is made using a compressor map, such as the example shown in FIG. 3. In these examples, the process 200 makes this determination based on whether first and second parameters (304 and 302) map to an operating level within the operating zone 306 or not. Other techniques may also be utilized.

Further, the determination at step 212 also includes determining how long the compressor is operating outside the operating zone. This time may be any period of time and may typically be long enough to allow for the system to establish a steady state. For example, it may be a between 5-20 minutes. In some examples, the time restarts anytime the operating level reenters the operating zone, and in other examples it restarts only after the operating level reenters the operating zone for more than a transitory period of time, e.g., 1-2 mins.

If at step 212 the process 200 determines that the compressor is at an operating level outside of the operating zone for more than a period of time, that determination provides an indication that the bypass circuit should be utilized. If not, then the step at 212 may indicate that the bypass circuit should not be utilized, and the process may repeat.

The process 200 also includes step 214 which allows for another determination of whether the bypass circuit should be utilized or not. At step 214 the process determines whether the outdoor ambient temperature is below a temperature threshold. In some examples, this step is directed to determining a typically cold conditions exist, which may stress the compressor during heating mode.

At step 214, the process determines the outdoor ambient temperature, potentially based on the monitoring performed at step 204. This outdoor ambient temperature is then compared to a temperature threshold. In some examples, the temperature threshold may be between 20° F.-30° F., and potentially at about 25° F. It is understood that other values may be used as well. (It is also understood that the reverse process may provide a similar indication in cooling mode, e.g., a determination that the outdoor ambient temperature is atypically hot in cooling may indicate the compressor is stressed.)

If at step 214 the process 200 determines that outdoor ambient temperature is sufficiently low, then that determination provides an indication that the bypass circuit should be utilized. If not, then the step at 214 may indicate that the bypass circuit should not be utilized, and the process may repeat.

In the depicted example, if the process 200 indicates via step 212 and/or step 214 that the bypass circuit should be utilized, then the process continues to step 216. At step 216 the process 200 adjusts the position of a valve coupled to the wet-injection bypass line. As indicated above, this may include opening the valve to allow the climate control system to utilize the bypass circuit. For example, as discussed above, the bypass circuit may be configured in various different ways, and thus, in some examples, adjusting the valve position includes opening a solenoid valve coupled to the bypass circuit to allow refrigerant to flow through bypass circuit. In other examples, adjusting the valve position included opening a modulating valve coupled to the bypass circuit at a given position to allow refrigerant to flow through the bypass circuit. Still other examples may be utilized.

Figure 4:
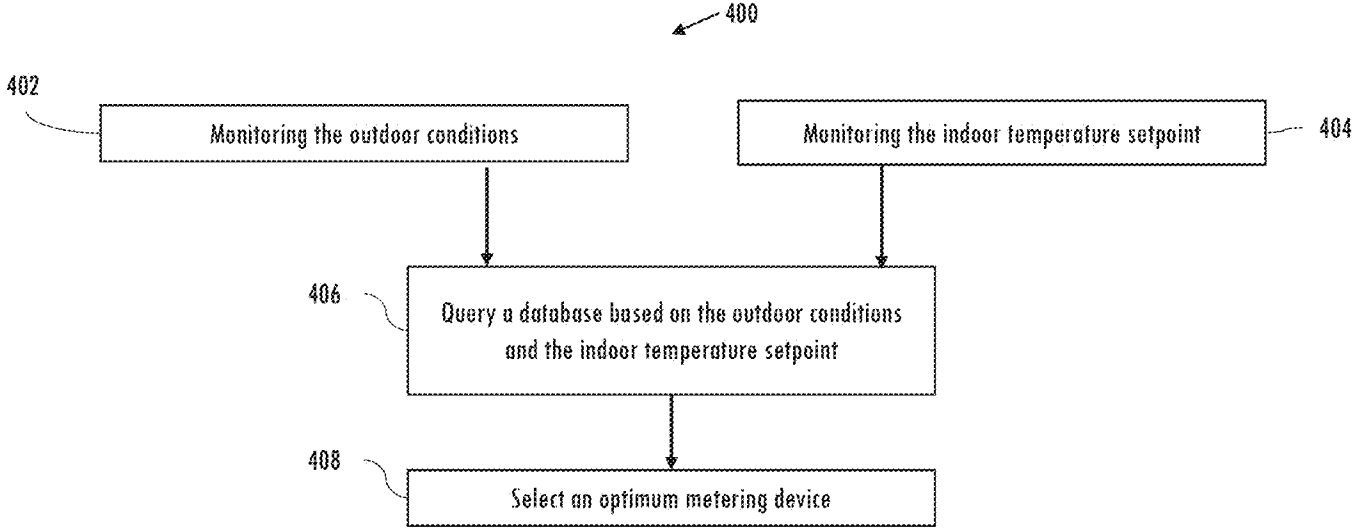
FIG. 4 is a flow chart illustrating various steps of selecting an optimum capillary size of a climate control system, according to various example implementations.

Further, in some examples, adjusting a valve position at step 216 may include more than initiating the bypass circuit, it may also include adjusting or setting the flow rate. For example, this process may further include process 400 to determine the appropriate flow rate through the bypass circuit. FIG. 4 shows an example process for making this determination, and how the valve position may be adjusted. Further, in some examples, the valve position is further adjusted as the outdoor ambient temperature continues to become more extreme. For example, as the outdoor ambient temperature deviates further from the threshold temperature, e.g., drops further below that temperature in heating mode, the process may increase the flow of refrigerant through the bypass line by adjusting the valve position further. This may be done through the process described in connection with FIG. 4, or through other processes.

Further, the process 200 may close the valve after adjusting the valve position at step 216 when it is determined the compressor is operating within the operating zone. The indoor 202 and outdoor conditions 204 may be continuously updated. The first and second parameter 206 may be continuously monitored to determine a current level of operation 208 within the loaded operating zone 210. In other words, each determination in process 200 may work in reverse to determine the system is within an operating zone and any open bypass valve should be closed at step 212, if open.

FIG. 4 shows a flow diagram of an example process 400 that may be utilized to select an optimum capillary size for use in an embodiment of process 200. Process 400 may further monitor one or more conditions and parameters, e.g., pressures, temperatures, or the like as described above, of a climate control system. The process 400 may be carried out, at least partially, by one or more apparatuses, components, circuits, and/or the like according to some examples of the present disclosure. In some examples, the process 400 may be performed by a least the control circuitry, e.g., 120, 800, or the like. In some examples, the process 400 may be performed by two or more control circuits that are, at least in part, communicatively coupled together, e.g., a system controller, outdoor controller, indoor controller, or the like. In some examples, the process 400 may utilize one or more other components coupled to the control circuitry, including without limitation, the compressor 106, the outdoor metering device 110, the plurality of sensors 130, 128, 118, and 124, the bypass valve(s) 114 and/or the like as described herein. In some examples, the process 400 may, at least in part, be included in the control circuitry 120, e.g., as a controller algorithm, executable program code, or the like, and may be stored on the control circuitry 120 of a climate control system 100 as described above.

Moreover, the process 400 as illustrated may be an at least partially closed loop process; however, in some examples other operations and processes as described herein may be incorporated, at least in part, into process 200.

Turning now to FIG. 4, the process 400 is shown to determine the selection of an optimum capillary circuit to adjust the valve coupled to the wet-injection bypass line as described in an example of process 200 at step 216.

Once it is determined from process 200 step 216 that the bypass valve's position should be adjusted, process 400 may determine an optimum metering device to bring the current level of operation within the operating zone. As shown at operation 402, the process 400 includes determining outdoor condition(s) at step 402, and the indoor temperature setpoint at step 404. The process 400 further includes querying a database based on the outdoor conditions and the indoor temperature setpoint. The process 400 continues to select an optimum metering device at step 408. In some examples the optimum metering device selected by process 400 corresponds to a capillary size of one of multiple bypass metering devices as shown and described in FIG. 1B above. In another example, the optimum metering device corresponds to one of multiple modulating valve positions as described in FIG. 1C above. Again, other examples may be used in accordance with the teachings herein.

To walk through each of these steps in more detail, at step 402 the conditions of the outside ambient environment are monitored. This includes monitoring the temperature of the outdoor environment and potentially other conditions such as humidity, etc. This monitoring may be performed using a sensor, potentially a temperature sensor located on an outdoor unit of a split system, or through another method. For example, outdoor conditions may be monitored by receiving data from available sources, such as internet sources.

As shown at step 404, the process 400 includes determining an indoor setpoint. The operation of 404 may further include transmitting, from the thermostat, a command signal representative of a command to measure and/or record a thermostat setpoint. The operation 404 may further include transmitting, from the thermostat, the temperature setpoint. The operation 404 may further include transmitting, from the thermostat (or other user interface) to the control circuitry, a temperature setpoint.

In some examples, steps 402 and 404 are used to determine the actual or potential conditioning load on a climate control system. For example, the outdoor conditions may be, in part, indicative of a heating (or cooling) load associated with a given conditioned space. The indoor temperature setpoint may be indicative of the desired conditions for the space. Using that desired condition, e.g., desired temperature, and the outdoor conditions, the process 400 may determine the given demand on the system, e.g., the load the system is being asked to satisfy. It is understood that other methods (or values) may also be used to determine the given demand in a similar manner to the process described herein. For example, an actual temperature value of the indoor space may be used, and/or a deviation of the actual temperature from the temperature setpoint. Still other processes may be utilized.

Returning to the depicted process 400, as shown at operation 406, the process 400 includes querying a database based on the outdoor conditions and the indoor temperature setpoint. This database may correlate these values (or a given load, etc.) to a desired refrigerant flow through the bypass circuit. For example, this database may be built to optimize the refrigerant flows through the bypass circuit based on these values. For example, the database may be built by the process in FIG. 5. Regardless, the operation 406 may use the outdoor conditions of step 402 and the temperature setpoint of step 404 to query a database to determine the appropriate refrigerant flow through the bypass line. In some examples, the database correlates these values with a given capillary size. In other examples, the database correlates these values to a given electronic expansion valve position, or more generally, a modulating valve position. It is understood that other metering devices may be utilized, and the database may correspond to these metering devices in a similar manner. It is also understood that other process may be used to determine the optimum metering device(s) (opening/size/number).

In some examples, the database correlates the outdoor conditions, e.g., the outdoor ambient temperature, to a desired refrigerant flow rate. For example, if the outdoor ambient temperature is below the temperature threshold (in heating mode) indicating the bypass circuit should be utilized, the database may increase the amount of refrigerant flow as the outdoor ambient temperature continues to decrease below the threshold value. In some examples, the refrigerant flow rate is correlated to the amount the outdoor ambient temperature is below the temperature threshold, e.g., the flow rate is directly related (via a linear relationship or otherwise) to the amount the outdoor ambient temperature deviates from the temperature threshold. Again, other processes may be utilized.

As shown at operation 408, the process 400 includes selecting an optimum metering device using the query from operation 406. This step may include selecting the metering device that corresponds to the values obtained in steps 402 and 404 in the database, and/or the metering device that best approximates that corresponding metering device.

To continue using the above examples, the bypass line may include a plurality of capillary tube circuits routed in parallel. In some examples, each capillary tube circuit may have a different capillary size, and thus, selecting the optimum metering device at step 408 may include selecting the capillary tube size that corresponds to the values to the optimum metering device. And thus, in these examples, adjusting the valve coupled to wet injection bypass in step 216 of process 200 may include opening the solenoid valve coupled to the selected capillary tube size. This process allows the appropriate amount of refrigerant to flow through the bypass circuit.

In other examples, also including a bypass line with a plurality of capillary tube circuits routed in parallel, selecting the optimum metering device at step 408 may include selecting two or more capillary tubes. In these examples, the optimum metering device may correspond to the opening associated with two (or more) of the capillary tubes combined. Thus, in these examples, adjusting the valve coupled to wet injection bypass in step 216 of process 200 may include opening the solenoid valves coupled to the two or more capillary tube circuits.

In still another example, the bypass line may include a modulating valve and an electronic expansion valve. In these examples, the optimum metering device may correspond to a valve position associated with the electronic expansion valve and/or a valve position in the modulating valve. For example, the optimum metering device may correspond to a refrigerant flow rate through the bypass line to address the given load. In some examples, this corresponds to opening the electronic expansion valve to a position that corresponds to the optimum metering device. In some examples, the modulating valve position is selected to determine an appropriate flow rate for the refrigerant fluid, and the position for the electronic expansion valve is selected to allow for that appropriate flow rate to "flash", e.g., evaporate, upon rejoining the refrigerant in the main circuit as indicated above.

Again, it is understood that other metering devices may be utilized and controlled in the same or a similar manner in keeping with the teachings herein.

Figure 5:
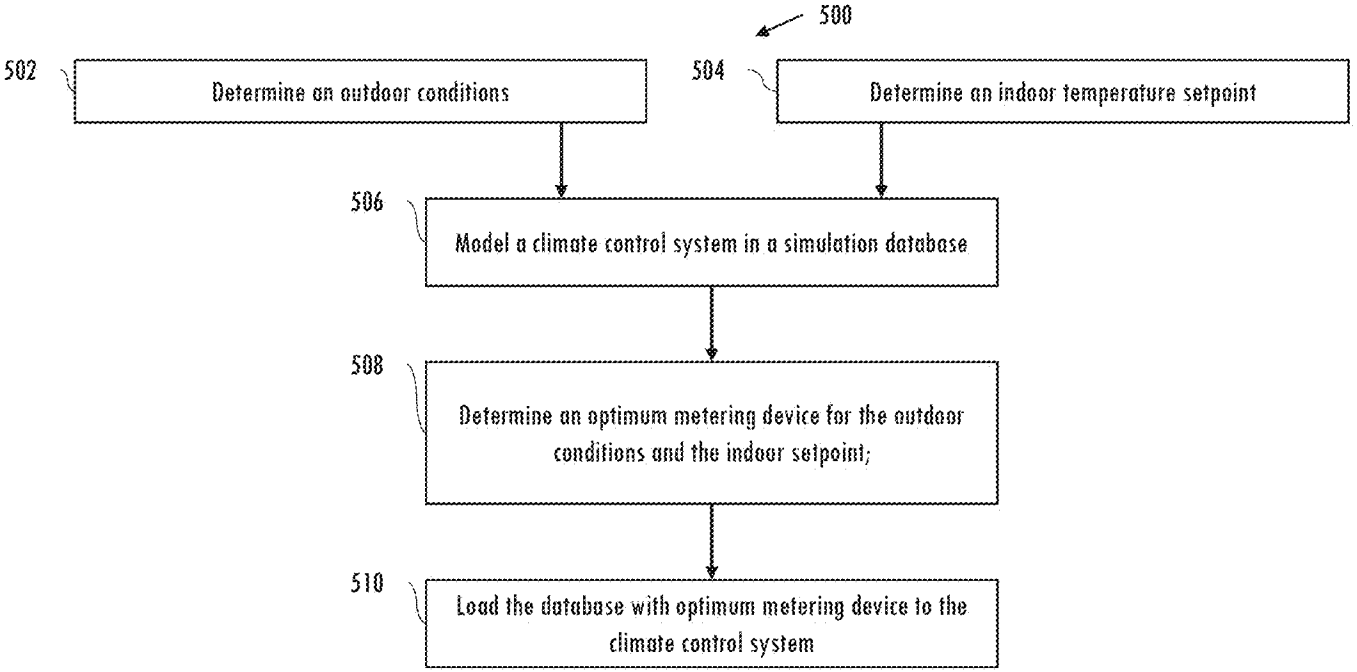
FIG. 5 is a flow chart illustrating various steps of building a capillary database of a climate control system, according to various example implementations.

FIG. 5 shows a flow diagram of an example process 500 that may be utilized to load the database with optimum metering device(s) for different operating conditions. This may include determining conditions at which utilizing the bypass circuit improves the overall performance of the climate control system 100. The process 500 may be carried out, at least partially, by one or more apparatuses, components, circuits, and/or the like according to some examples of the present disclosure. In some examples, this process is carried out during manufacturing to assist in the design (and/or calibration) of a given climate control system or line of climate control systems. In some examples, the process 500 may be performed by a least the control circuitry, e.g., 120, 800, or the like. In some examples, the process 500 may be performed by two or more control circuits that are, at least in part, communicatively coupled together, e.g., a system controller, outdoor controller, indoor controller, or the like. In some examples, the process 500 may, at least in part, be included in the control circuitry 120, e.g., as a controller algorithm, executable program code, or the like, and may be stored on the control circuitry 120 of a climate control system 100 as described above.

Moreover, the process 500 as illustrated may be an at least partially closed loop process; however, in some examples other operations and processes as described herein may be incorporated, at least in part, into process x500.

Turning to FIG. 5, a process is described for creating a database for use in operation 406 of process 400. The database determines the optimum metering device(s) for the specific operating conditions measured by the climate control system.

As shown in operation 502, process 500 determines outdoor conditions e.g., outdoor environment temperatures. The operation 502 may occur simultaneously with step 204 of process 200 and or step 402 of process 400. The operation of 502 may further include transmitting, from the control circuitry to the outdoor temperature sensor, a command signal representative of a command to measure and/or record a temperature of the outdoor environment. The operation 502 may further include transmitting, from the outdoor temperature sensor to the control circuitry, a temperature measurement representative of the outdoor environment. In some examples, the operation 502 may include measuring and/or recording an outdoor environment temperature measurement.

As shown at operation 504, the process 500 includes determining an indoor setpoint. The operation of 504 may further include transmitting, from the control circuitry to the thermostat, a command signal representative of a command to measure and/or record a thermostat setpoint. The operation 504 may further include transmitting, from the thermostat to the control circuitry, the temperature setpoint. The operation 504 may further include transmitting, from the thermostat to the control circuitry, a temperature setpoint.

In some examples, steps 502 and 504 are determined using representative data (or simulation data) associated with a potential location associated with a climate control system. For example, the outdoor conditions may be determined from known, or historical, weather data associated with a given location. Similarly, indoor temperature setpoint may be assumed or determined using typical user preferences, e.g., it may be set to between 70° F.-75° F.

Process 500 continues with step 506, modeling a climate control system in a simulation database. This modeling may be performed on any modeling program, and it may be selected to run based on the inputs received above, e.g., outdoor conditions and temperature setpoint, and/or other conditions. Further, the simulation may be performed on a given climate control system or a line of climate control systems. For example, modeling may be performed on each make and/or model of a given climate control system. Further these simulations may be based on regions with similar weather patterns. Other inputs and more complex techniques may also be utilized.

As shown at operation 508, the process 500 includes determining an optimum metering for the outdoor conditions measured in step 502 and the indoor temperature setpoint measured in 504. Step 508 further includes optimizing the selection with the test results by linking the determined outdoor conditions and indoor temperature setpoint to the capillary selection in a database format.

In this example, the process 500 may run a simulation based on the outdoor conditions and the indoor temperature setpoint to determine when, and to what amount, to utilize the bypass circuit. This may include determining the optimized metering device size that corresponds to these conditions. Further, this process may be specific to a particular climate control system design, e.g., make and model, tonnage, etc. This process may determine the optimized metering device in any amount, e.g., corresponding to standard capillary tube sizes, standard valve positions, etc. Once determined, these results may be used to design the climate control system with the resulting metering devices. For example, a climate control system may be designed with three capillary tube circuits and each of these capillary tube circuits may be selected based on this process, e.g., the capillary tube sizes that correspond to the most (or most extreme) conditions where the bypass circuit may be utilized.

Step 508 may also include creating a database based on the simulations that correlates these various conditions with the optimum metering device(s), which may be used in the manner discussed above.

Process 500 may also include loading the database onto the climate control system at step 510. This process may be the same or similar to the process step 210. In some examples, the database created as part of step 506 is loaded onto the one or more of the memories associated with the climate control system as part of the manufacturing process of the climate control system. Again, this database may be determined as part of the testing or calibration of the climate control system (or line of climate control systems) and it may be uploaded to one of the memories associated with the system as part of that process. In other examples, the database is loaded by a service technician during installation or maintenance of a given system, via a software update, or through any other process.

Figure 6:
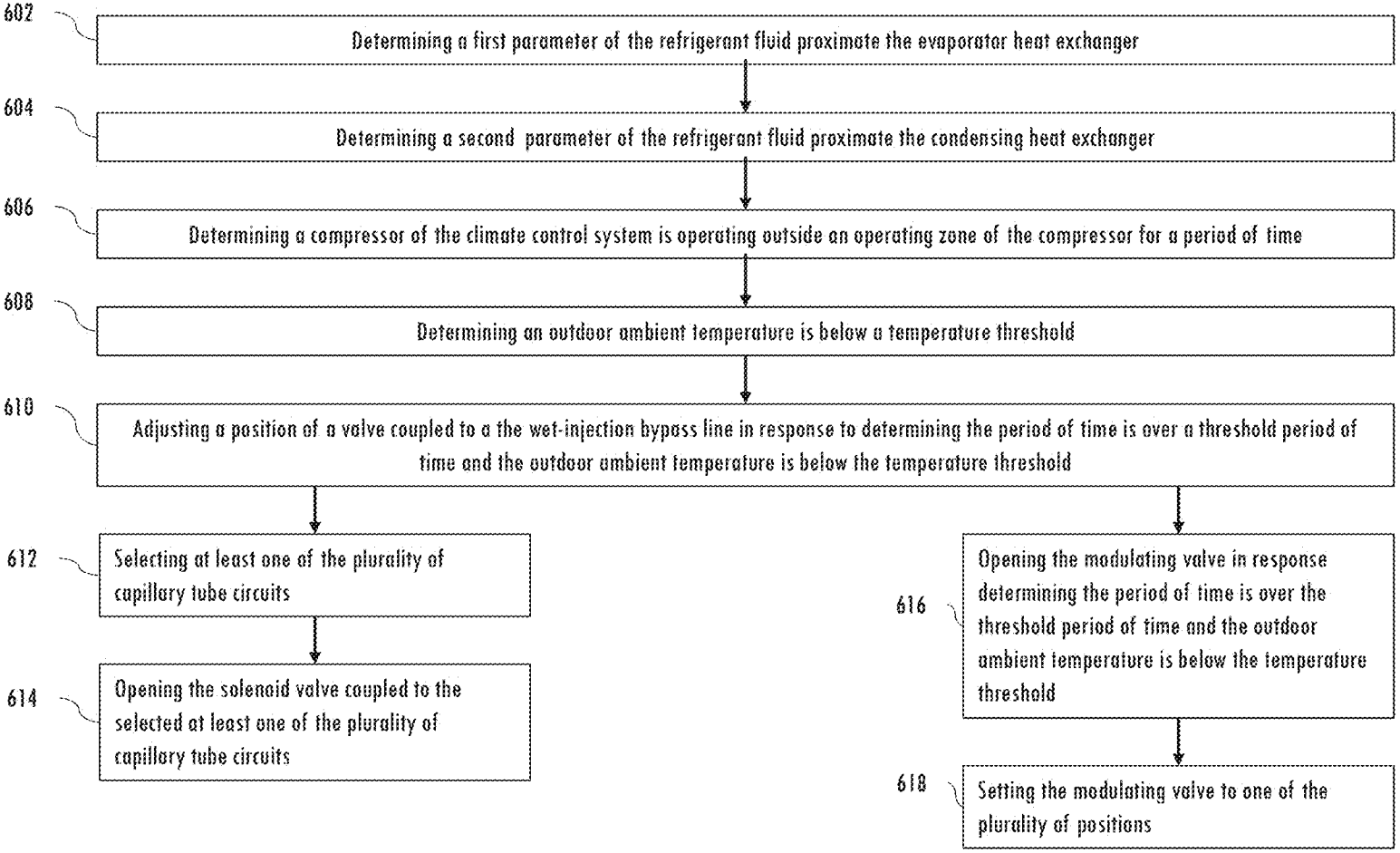
FIG. 6 is a flow chart illustrating various steps of adjusting a bypass valve(s) of a climate control system, according to various example implementations.

FIG. 6 shows an example process 600 for adjusting the flow rate of the portion of refrigerant routed through a wet-injection bypass line. This process may include several of the same or similar steps to the processes discussed above in connection with FIGS. 2-5. The process 600 may be carried out, at least partially, by one or more apparatuses, components, circuits, and/or the like according to some examples of the present disclosure. In some examples, the process 600 may be performed by at least the control circuitry, e.g., 120, 800, or the like. In some examples, the process 600 may utilize one or more other components coupled to the control circuitry, including without limitation, the compressor 106, the outdoor metering device 110, the plurality of sensors 130, 118, 128, 124, and, and/or the like as described herein. In some examples, the process 600 may, at least in part, be included in the control circuitry 120, e.g., as a controller algorithm, executable program code, or the like, and may be stored on the control circuitry 120 of a climate control system 100 as described above.

The process 600 begins by determining a first parameter of the refrigerant fluid proximate the evaporator heat exchanger, as show at operation 602. The process 600 further determines a second parameter of the refrigerant fluid proximate the condensing heat exchanger, as shown at operation 604. The process 600 further includes determining if a compressor of the climate control system is operating outside an operating zone of the compressor for a period of time, as shown at operation 606. The process 600 further includes determining an outdoor ambient temperature is below a temperature threshold, as shown at operation 608. The process 600 further includes step 610, adjusting a position of a valve coupled to a the wet-injection bypass line in response to determining the period of time is over a threshold period of time and the outdoor ambient temperature is below the temperature threshold. In some examples, the process 600 may open a single solenoid bypass valve coupled to the wet-injection bypass line.

In some examples, the process 600 may be a climate control system including a plurality of capillary tubes circuits routed in parallel, each of the plurality of capillary tube circuits including a solenoid valve and a capillary tube, and the process 600 may proceed to steps 612 and 614. In the present example, step 610 may further include selecting at least one of the plurality of capillary tube circuits, as show at step 612; and opening the solenoid valve coupled to the selected at least one of the plurality of capillary tube circuits, as show at step 614.

In another example, the process 600 may be a climate control system including a modulating valve as a bypass valve, and the process 600 may proceed from step 610 to steps 616 and 618. As show in 616, the process 600 includes opening the modulating valve in response determining the period of time is over the threshold period of time and the outdoor ambient temperature is below the temperature threshold. This example further includes step 618, setting the modulating valve to one of the plurality of positions.

Figure 7:
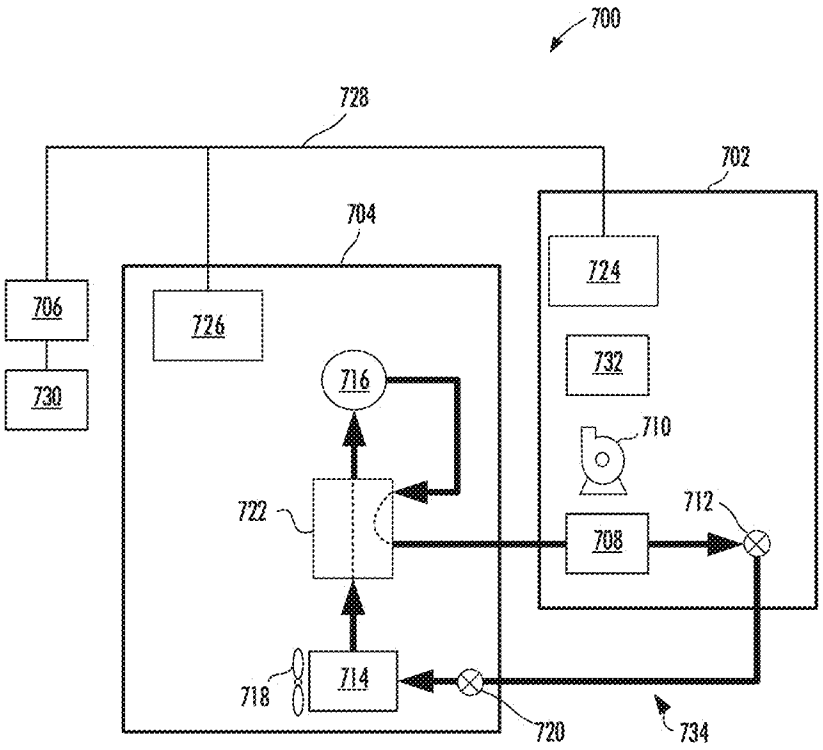
FIG. 7 is a schematic view of a climate control system, according to some example implementations of the present disclosure.

FIG. 7 shows a schematic diagram for at least an example climate control system 700, which may be the same or similar to climate control system 100 discussed above. In some examples, the climate control system 700 comprises a heat pump system that may be selectively operated to implement one or more substantially closed thermodynamic refrigerant cycles to provide a cooling functionality (hereinafter a "cooling mode") and/or a heating functionality (hereinafter a "heating mode"). The examples depicted in FIG. 7 are configured in a heating mode. The climate control system 700, in some examples is configured as a split system heat pump system, and generally comprises an indoor unit 702, an outdoor unit 704, and a system controller 706 that may generally control operation of the indoor unit 702 and/or the outdoor unit 704. The indoor unit 702 and the outdoor unit 704 may be fluidly coupled via the refrigerant fluid circuit 734. It is understood that while the example depicted in FIG. 7 shows a split system configuration with an indoor unit 702 and an outdoor unit 704 as separate components, the climate control system may also be a packaged unit with the components of the outdoor unit 702 and the indoor unit 704 in a single housing. Still other configurations may be utilized.

Indoor unit 702 generally comprises an indoor air handling unit comprising an indoor heat exchanger 708, an indoor fan 710, an indoor metering device 712, and an indoor controller 724. The indoor heat exchanger 708 may generally be configured to promote heat exchange between a refrigerant fluid carried within internal tubing of the indoor heat exchanger 708 and an airflow that may contact the indoor heat exchanger 708 but that is segregated from the refrigerant fluid. Indoor unit 702 may at least partially include, or be coupled to, a duct system 732 including one or more of an air return duct, a supply duct, a register, a vent, a damper, an air filter, or the like for providing airflow.

The indoor metering device 712 may generally comprise an electronically controlled motor-driven electronic expansion valve (EEV). In some examples, however, the indoor metering device 712 may comprise a thermostatic expansion valve, a capillary tube assembly, and/or any other suitable metering device.

Outdoor unit 704 generally comprises an outdoor heat exchanger 714, a compressor 716, an outdoor fan 718, an outdoor metering device 720, a switch over valve 722, and an outdoor controller 726. The compressor 716 may be any type of compressor, including a compressor the same or similar to compressors discussed above. The outdoor heat exchanger 714 may generally be configured to promote heat transfer between a refrigerant fluid carried within internal passages of the outdoor heat exchanger 714 and an airflow that contacts the outdoor heat exchanger 714 but is segregated from the refrigerant fluid.

The outdoor metering device 720 may generally comprise a thermostatic expansion valve. In some examples, however, the outdoor metering device 720 may comprise an electronically controlled motor driven EEV similar to indoor metering device 712, a capillary tube assembly, and/or any other suitable metering device.

In some examples, the switch over valve 722 may generally comprise a four-way reversing valve. The switch over valve 722 may also comprise an electrical solenoid, relay, and/or other device configured to selectively move a component of the switch over valve 722 between operational positions to alter the flow path of refrigerant fluid through the switch over valve 722 and consequently the climate control system 700. Additionally, the switch over valve 722 may also be selectively controlled by the system controller 706, an outdoor controller 726, and/or the indoor controller 724.

The system controller 706 may generally be configured to selectively communicate with the indoor controller 724 of the indoor unit 702, the outdoor controller 726 of the outdoor unit 704, and/or other components of the climate control system 700. In some examples, the system controller 706 may be configured to control operation of the indoor unit 702, and/or the outdoor unit 704. In some examples, the system controller 706 may be configured to monitor and/or communicate with a plurality of temperature and pressure sensors associated with components of the indoor unit 702, the outdoor unit 704, and/or the outdoor ambient environment.

Additionally, in some examples, the system controller 706 may comprise a temperature sensor and/or may further be configured to control heating and/or cooling of conditioned spaces or zones associated with the climate control system 700. In some examples, the system controller 706 may be configured as a thermostat for controlling the supply of conditioned air to zones associated with the climate control system 700, and in some examples, the thermostat includes a temperature sensor.

The system controller 706 may also generally comprise an input/output (I/O) unit (e.g., a graphical user interface, a touchscreen interface, or the like) for displaying information and for receiving user inputs. The system controller 706 may display information related to the operation of the climate control system 700 and may receive user inputs related to operation of the climate control system 700. However, the system controller 706 may further be operable to display information and receive user inputs tangentially related and/or unrelated to operation of the climate control system 700. In some examples, the system controller 706 may not comprise a display and may derive all information from inputs that come from remote sensors and remote configuration tools.

In some examples, the system controller 706 may be configured for selective bidirectional communication over a communication bus 728, which may utilize any type of communication network. For example, the communication may be via wired or wireless data links directly or across one or more networks, such as a control network. Examples of suitable communication protocols for the control network include CAN, TCP/IP, BACnet, LonTalk, Modbus, ZigBee, Zwave, Wi-Fi, SIMPLE, Bluetooth, and the like.

The indoor controller 724 may be carried by the indoor unit 702 and may generally be configured to receive information inputs, transmit information outputs, and/or otherwise communicate with the system controller 706, the outdoor controller 726, and/or any other device 730 via the communication bus 728 and/or any other suitable medium of communication. In some examples, the device 730 may include some or all of the systems described by the present disclosure. For example, the device 730 may be a sensor, or the like, as described by the present disclosure. In some examples, the device 730 may be housed within at least a unit (e.g., 702, 704, etc.) of the climate control system 700 and/or coupled thereto. In some examples, the device 730 may be a plurality of devices, each device 730 being associated with one or more units of the climate control system 700.

The outdoor controller 726 may be carried by the outdoor unit 704 and may be configured to receive information inputs from the system controller 706, which may be a thermostat. In some examples, the outdoor controller 726 may be configured to receive information related to an ambient temperature associated with the outdoor unit 704, information related to a temperature of the outdoor heat exchanger 714, and/or information related to refrigerant temperatures and/or pressures of refrigerant entering, exiting, and/or within the outdoor heat exchanger 714 and/or the compressor 716.

Figure 8:
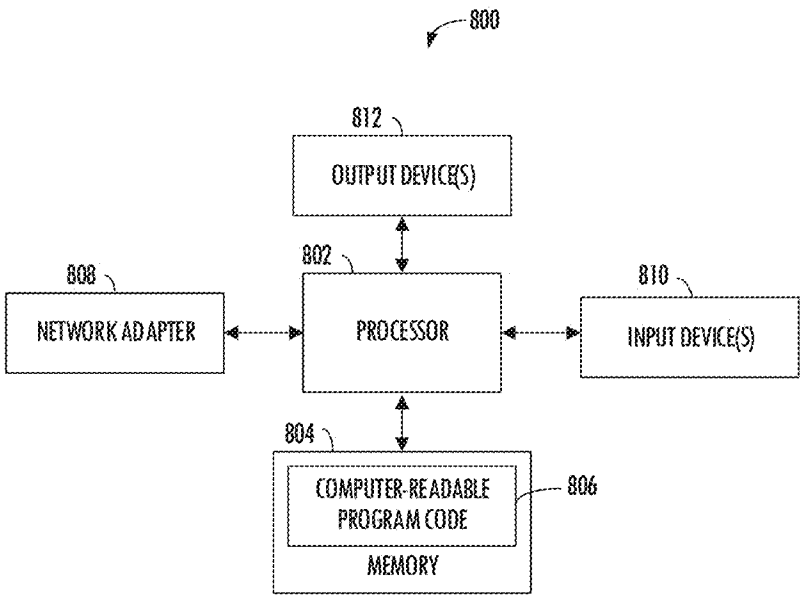
FIG. 8 illustrates a control circuitry according to some example implementations.

FIG. 8 illustrates the control circuitry 800, which may be an apparatus, according to some examples of the present disclosure. In some examples the control circuitry 800 includes some or all of the system controller 706, the indoor controller 724, the outdoor controller 726, or any other similar apparatus as described by the present disclosure. In some examples, the control circuitry 800 may include one or more of each of a number of components such as, for example, a processor 802 connected to a memory 804. The processor is generally any piece of computer hardware capable of processing information such as, for example, data, computer programs and/or other suitable electronic information. The processor includes one or more electronic circuits some of which may be packaged as an integrated circuit or multiple interconnected integrated circuits (an integrated circuit at times more commonly referred to as a "chip"). The processor 802 may be a number of processors, a multi-core processor or some other type of processor, depending on the particular example.

The processor 802 may be configured to access and/or execute computer programs such as computer-readable program code 806, which may be stored onboard the processor or otherwise stored in the memory 804. In some examples, the processor may be embodied as, or otherwise include, one or more ASICs, FPGAs, or the like. Thus, although the processor may be capable of executing a computer program to perform one or more functions, the processor of various examples may be capable of performing one or more functions without the aid of a computer program.

The memory 804 is generally any piece of computer hardware capable of storing information such as, for example, data, computer-readable program code 806 or other computer programs, and/or other suitable information either on a temporary basis and/or a permanent basis. The memory may include volatile memory such as random-access memory (RAM), and/or non-volatile memory such as a hard drive, flash memory or the like. In various instances, the memory may be referred to as a computer-readable storage medium, which is a non-transitory device capable of storing information. In some examples, then, the computer-readable storage medium is non-transitory and has computer-readable program code stored therein that, in response to execution by the processor 802, causes the control circuitry 800 to perform various operations as described herein, some of which may in turn cause the climate control system to perform various operations.

In addition to the memory 804, the processor 802 may also be connected to one or more peripherals such as a network adapter 808, one or more input/output (I/O) devices (e.g., input device(s) 810, output device(s) 812) or the like. The network adapter is a hardware component configured to connect the control circuitry 800 to a computer network to enable the control circuitry to transmit and/or receive information via the computer network. The I/O devices may include one or more input devices capable of receiving data or instructions for the control circuitry, and/or one or more output devices capable of providing an output from the control circuitry. Examples of suitable input devices include a keyboard, keypad or the like, and examples of suitable output devices include a display device such as a one or more light-emitting diodes (LEDs), a LED display, a liquid crystal display (LCD), or the like.

As explained above and reiterated below, the present disclosure includes, without limitation, the following example implementations.

Clause 1. A method of controlling a wet-injection bypass line in a climate control system, the method comprising: circulating refrigerant fluid through a main refrigeration circuit to satisfy a conditioning load; selectively routing a portion of the refrigerant fluid through the wet-injection bypass line, the wet-injection bypass line routing the portion of the refrigerant from an upstream location on the main refrigerant circuit between an evaporator heat exchanger and a condensing heat exchanger to a downstream location on the main refrigerant circuit proximate a compressor inlet; controlling a flow rate of the portion of the refrigerant fluid through the wet-injection bypass line, wherein controlling the flow rate includes: determining a first parameter of the refrigerant fluid proximate the evaporator heat exchanger and a second parameter of the refrigerant fluid proximate the condensing heat exchanger, determining a compressor of the climate control system is operating outside an operating zone of the compressor for a period of time, determining an outdoor ambient temperature is below a temperature threshold, and adjusting a position of a valve coupled to the wet-injection bypass line in response to determining the period of time is over a threshold period of time and the outdoor ambient temperature is below the temperature threshold.

Clause 2. The method of any of the clauses, wherein the wet-injection bypass line of the climate control system includes a plurality of capillary tube circuits routed in parallel, each of the plurality of capillary tube circuits including a solenoid valve and a capillary tube, wherein adjusting the position of the valve further includes: selecting at least one of the plurality of capillary tube circuits; and opening the solenoid valve coupled to the selected at least one of the plurality of capillary tube circuits.

Clause 3. The method of any of the clauses, wherein each of the plurality of capillary tubes has a different capillary size, and wherein selecting the at least one of the plurality of capillary tube circuits includes selecting the at least one of the plurality of capillary tube circuits based on the outdoor ambient temperature and an indoor temperature setpoint.

Clause 4. The method of any of the clauses, wherein each of the different capillary sizes are determined using a simulation, each capillary size corresponding to a simulated conditioned associated with the simulation, and wherein selecting the at least one of the plurality of capillary tube circuits includes selecting the capillary size based on the outdoor ambient temperature and the indoor temperature setpoint that correspond approximately to the simulated condition associated with the capillary size.

Clause 5. The method of any of the clauses, wherein the at least one of the plurality of capillary tube circuits is two or more of the plurality of capillary tube circuits.

Clause 6. The method of any of the clauses, wherein the wet-injection bypass line of the climate control system includes a modulating valve, the modulating valve adjustable between a plurality of positions, wherein adjusting the position of the valve further includes: opening the modulating valve in response to determining the period of time is over the threshold period of time and the outdoor ambient temperature is below the temperature threshold; and setting the modulating valve to one of the plurality of positions.

Clause 7. The method of any of the clauses, wherein setting the modulating valve includes setting the modulating valve to one of the plurality of positions based on the outdoor ambient temperature and an indoor temperature setpoint.

Clause 8. The method of any of the clauses, wherein the operating zone corresponds to a compressor operating map, the compressor operating map indicating a range of acceptable operating levels.

Clause 9. The method of any of the clauses, wherein the first parameter of the refrigerant fluid at the evaporator heat exchanger is a saturation temperature for the evaporator heat exchanger, and the second parameter of the refrigerant fluid at the condensing heat exchanger is a saturation temperature for the condensing heat exchanger.

Clause 10. The method of any of the clauses, further comprising operating the climate control system in a heating mode; and wherein the threshold temperature is 25° F.

Clause 11. The method of any of the clauses, wherein adjusting the position of the valve further includes adjusting the position of the valve to increase the flow rate of the portion of refrigerant fluid in response to determining the outdoor ambient temperature is below 25° F. by a certain amount.

Clause 12. The method of any of the clauses, wherein the portion of refrigerant fluid routed through the bypass line is in a predominately liquid state at the upstream location on the main refrigerant circuit between the evaporator heat exchanger and the condensing heat exchanger.

Clause 13. A climate control system comprising: a main refrigeration circuit configured to circulate refrigerant fluid to satisfy a conditioning load; a wet-injection bypass line coupled to an upstream location on the main refrigerant circuit between an evaporator heat exchanger and a condensing heat exchanger and a downstream location on the main refrigerant circuit proximate a compressor inlet, the wet-injection bypass line configured to selectively route a portion of the refrigerant fluid from the main refrigeration circuit through the wet-injection bypass line, wherein the wet-injection bypass line includes a plurality of capillary tube circuits routed in parallel, each of the plurality of capillary tube circuits including a solenoid valve and a capillary tube; and a controller including a processor and a memory configured to store computer-readable program code including a control-related software application; and the processor configured to access the memory, and execute the computer-readable program code to cause the processor to at least: determine a first parameter of the refrigerant fluid proximate the evaporator heat exchanger and a second parameter of the refrigerant fluid proximate the condensing heat exchanger, determine a compressor of the climate control system is operating outside an operating zone of the compressor for a period of time, determine an outdoor ambient temperature is below a temperature threshold, and in response to determining the period of time is over a threshold period of time and the outdoor ambient temperature is below the temperature threshold, select at least one of the plurality of capillary tube circuits, and open the solenoid valve coupled to the selected at least one of the plurality of capillary tube circuits.

Clause 14. The climate control system of any of the clauses, wherein each of the plurality of capillary tubes has a different capillary size, and wherein causing the processor to select at least one of the plurality of capillary tube circuits further includes causing the processor to: select the at least one of the plurality of capillary tube circuits based on the outdoor ambient temperature and an indoor temperature setpoint.

Clause 15. The climate control system of any of the clauses, wherein each of the different capillary sizes are determined using a simulation, each capillary size corresponding to a simulated conditioned associated with the simulation, and wherein causing the processor to select at least one of the plurality of capillary tube circuits further includes causing the processor to: select the capillary size based on the outdoor ambient temperature and the indoor temperature setpoint that correspond approximately to the simulated condition associated with the capillary size.

Clause 16. The climate control system of any of the clauses, wherein the at least one of the plurality of capillary tube circuits is two or more of the plurality of capillary tube circuits.

Clause 17. The climate control system of any of the clauses, wherein the processor configured to access the memory, and execute the computer-readable program code further includes causing the processor to: operate the climate control system in a heating mode; and wherein the threshold temperature is 25° F.

Clause 18. The climate control system of any of the clauses, wherein the operating zone corresponds to a compressor operating map, the compressor operating map indicating a range of acceptable operating levels.

Clause 19. The climate control system of any of the clauses, wherein the first parameter of the refrigerant fluid at the evaporator heat exchanger is a saturation temperature for the evaporator heat exchanger, and the second parameter of the refrigerant fluid at the condensing heat exchanger is a saturation temperature for the condensing heat exchanger.

Clause 20. The climate control system of any of the clauses, wherein the portion of refrigerant fluid routed through the bypass line is in a predominately liquid state at the upstream location on the main refrigerant circuit between the evaporator heat exchanger and the condensing heat exchanger.

Clause 21. A climate control system comprising: a main refrigeration circuit configured to circulate refrigerant fluid to satisfy a conditioning load; a wet-injection bypass line coupled to an upstream location on the main refrigerant circuit between an evaporator heat exchanger and a condensing heat exchanger and a downstream location on the main refrigerant circuit proximate a compressor inlet, the wet-injection bypass line configured to selectively route a portion of refrigerant fluid from the main refrigeration circuit through the wet-injection bypass line, wherein the wet-injection bypass line includes a modulating valve, the modulating valve adjustable between a plurality of positions; and a controller including a processor and a memory configured to store computer-readable program code including a control-related software application; and the processor configured to access the memory, and execute the computer-readable program code to cause the processor to at least: determine a first parameter of the refrigerant fluid proximate the evaporator heat exchanger and a second parameter of the refrigerant fluid proximate the condensing heat exchanger, determine a compressor of the climate control system is operating outside an operating zone of the compressor for a period of time, determine an outdoor ambient temperature is below a temperature threshold, and adjust a position of the modulating valve coupled to the wet-injection bypass line in response to determining the period of time is over a threshold period of time and the outdoor ambient temperature is below the temperature threshold.

Clause 22. The climate control system of any of the clauses, wherein causing the processor to adjust the position of the modulating valve further includes causing the processor to: open the modulating valve in response determining the period of time is over the threshold period of time and the outdoor ambient temperature is below the temperature threshold; and set the modulating valve to one of the plurality of positions.

Clause 23. The climate control system of any of the clauses, wherein causing the processor to set the modulating valve to one of the plurality of positions further includes causing the processor to: set the modulating valve to one of the plurality of positions based on the outdoor ambient temperature and an indoor temperature setpoint.

Clause 24. The climate control system of any of the clauses, wherein the processor configured to access the memory, and execute the computer-readable program code further includes causing the processor to: operate the climate control system in a heating mode; and wherein the threshold temperature is 25° F.

Clause 25. The climate control system of any of the clauses, wherein causing the processor to adjust the position of the valve further includes causing the processor to adjust the position of the valve to increase the flow rate of the portion of refrigerant fluid in response to determining the outdoor ambient temperature is below 25° F. by a certain amount.

Clause 26. The climate control system of any of the clauses, wherein the operating zone corresponds to a compressor operating map, the compressor operating map indicating a range of acceptable operating levels.

Clause 27. The climate control system of any of the clauses, wherein the first parameter of the refrigerant fluid at the evaporator heat exchanger is a saturation temperature for the evaporator heat exchanger, and the second parameter of the refrigerant fluid at the condensing heat exchanger is a saturation temperature for the condensing heat exchanger.

Clause 28. The climate control system of any of the clauses, wherein the portion of refrigerant fluid routed through the bypass line is in a predominately liquid state at the upstream location on the main refrigerant circuit between the evaporator heat exchanger and the condensing heat exchanger.

The above describes some implementations of the present disclosure more fully with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

For example, unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships, or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form.

Many modifications and other implementations of the disclosure set forth herein will come to mind to one skilled in the art to which the disclosure pertains having the benefit of the teachings presented in the foregoing description and the associated figures. Therefore, it is to be understood that the disclosure is not to be limited to the specific implementations disclosed and that modifications and other implementations are intended to be included within the scope of the appended claims. Moreover, although the foregoing description and the associated figures describe example implementations in the context of certain example combinations of elements and/or functions, it should be appreciated that different combinations of elements and/or functions may be provided by alternative implementations without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method of controlling a wet-injection bypass line in a climate control system, the method comprising:

circulating refrigerant fluid through a main refrigeration circuit to satisfy a conditioning load;

selectively routing a portion of the refrigerant fluid through the wet-injection bypass line, the wet-injection bypass line routing the portion of the refrigerant from an upstream location on the main refrigerant circuit between an evaporator heat exchanger and a condensing heat exchanger to a downstream location on the main refrigerant circuit proximate an inlet to a compressor;

controlling a flow rate of the portion of the refrigerant fluid through the wet-injection bypass line, wherein controlling the flow rate includes:

determining a first parameter of the refrigerant fluid proximate the evaporator heat exchanger and a second parameter of the refrigerant fluid proximate the condensing heat exchanger, determining the compressor of the climate control system is operating outside an operating zone of the compressor for a period of time, determining an outdoor ambient temperature is below a temperature threshold, and adjusting a position of a valve coupled to the wet-injection bypass line in response to determining the period of time is over a threshold period of time and the outdoor ambient temperature is below the temperature threshold.

2. The method of claim 1, wherein the wet-injection bypass line of the climate control system includes a plurality of capillary tube circuits routed in parallel, each of the plurality of capillary tube circuits including a solenoid valve and a capillary tube, wherein the valve is a first solenoid valve included in a first capillary tube circuit of the plurality of capillary tubes, and wherein adjusting the position of the valve further includes:

selecting at least one of the plurality of capillary tube circuits, the at least one of the plurality of capillary tube circuits including the first capillary tube circuit; and opening the first solenoid valve coupled to the first capillary tube circuit.

3. The method of claim 2, wherein each of the plurality of capillary tubes has a different capillary size, and wherein selecting the at least one of the plurality of capillary tube circuits includes selecting the at least one of the plurality of capillary tube circuits based on the outdoor ambient temperature and an indoor temperature setpoint.

4. The method of claim 3, wherein each of the different capillary sizes are determined using a simulation, each capillary size corresponding to a simulated conditioned associated with the simulation, and wherein selecting the at least one of the plurality of capillary tube circuits includes selecting the capillary size based on the outdoor ambient temperature and the indoor temperature setpoint that correspond approximately to the simulated condition associated with the capillary size.

5. The method of claim 2, wherein the at least one of the plurality of capillary tube circuits is two or more of the plurality of capillary tube circuits.

6. The method of claim 1, wherein the valve is a modulation valve, wherein the wet-injection bypass line of the climate control system includes the modulating valve, the modulating valve adjustable between a plurality of positions, wherein adjusting the position of the valve further includes:

opening the modulating valve in response to determining the period of time is over the threshold period of time and the outdoor ambient temperature is below the temperature threshold; and setting the modulating valve to one of the plurality of positions.

7. The method of claim 6, wherein setting the modulating valve includes setting the modulating valve to one of the plurality of positions based on the outdoor ambient temperature and an indoor temperature setpoint.

8. The method of claim 1, wherein the operating zone corresponds to a compressor operating map, the compressor operating map indicating a range of acceptable operating levels.

9. The method of claim 1, wherein the first parameter of the refrigerant fluid at the evaporator heat exchanger is a saturation temperature for the evaporator heat exchanger, and the second parameter of the refrigerant fluid at the condensing heat exchanger is a saturation temperature for the condensing heat exchanger.

10. The method of claim 1, further comprising operating the climate control system in a heating mode; and wherein the threshold temperature is 25° F.

11. The method of claim 10, wherein adjusting the position of the valve further includes adjusting the position of the valve to increase the flow rate of the portion of refrigerant fluid in response to determining the outdoor ambient temperature is below 25° F. by a certain amount.

12. The method of claim 1, wherein the portion of refrigerant fluid routed through the bypass line is in a predominately liquid state at the upstream location on the main refrigerant circuit between the evaporator heat exchanger and the condensing heat exchanger.

13. A climate control system comprising:

a main refrigeration circuit configured to circulate refrigerant fluid to satisfy a conditioning load;

a wet-injection bypass line coupled to an upstream location on the main refrigerant circuit between an evaporator heat exchanger and a condensing heat exchanger and a downstream location on the main refrigerant circuit proximate an inlet to a compressor, the wet-injection bypass line configured to selectively route a portion of the refrigerant fluid from the main refrigeration circuit through the wet-injection bypass line, wherein the wet-injection bypass line includes a plurality of capillary tube circuits routed in parallel, each of the plurality of capillary tube circuits including a solenoid valve and a capillary tube; and a controller including a processor and a memory configured to store computer-readable program code including a control-related software application; and the processor configured to access the memory, and execute the computer-readable program code to cause the processor to at least:

determine a first parameter of the refrigerant fluid proximate the evaporator heat exchanger and a second parameter of the refrigerant fluid proximate the condensing heat exchanger, determine the compressor of the climate control system is operating outside an operating zone of the compressor for a period of time, determine an outdoor ambient temperature is below a temperature threshold, and in response to determining the period of time is over a threshold period of time and the outdoor ambient temperature is below the temperature threshold, select at least one of the plurality of capillary tube circuits, and open the solenoid valve coupled to the selected at least one of the plurality of capillary tube circuits.

14. The climate control system of claim 13, wherein each of the plurality of capillary tubes has a different capillary size, and wherein causing the processor to select at least one of the plurality of capillary tube circuits further includes causing the processor to:

select the at least one of the plurality of capillary tube circuits based on the outdoor ambient temperature and an indoor temperature setpoint.

15. The climate control system of claim 14, wherein each of the different capillary sizes are determined using a simulation, each capillary size corresponding to a simulated conditioned associated with the simulation, and wherein causing the processor to select at least one of the plurality of capillary tube circuits further includes causing the processor to:

select the capillary size based on the outdoor ambient temperature and the indoor temperature setpoint that correspond approximately to the simulated condition associated with the capillary size.

16. The climate control system of claim 13, wherein the at least one of the plurality of capillary tube circuits is two or more of the plurality of capillary tube circuits.

17. The climate control system of claim 13, wherein the processor configured to access the memory, and execute the computer-readable program code further includes causing the processor to:

operate the climate control system in a heating mode; and wherein the threshold temperature is 25° F.

18. The climate control system of claim 13, wherein the operating zone corresponds to a compressor operating map, the compressor operating map indicating a range of acceptable operating levels.

19. The climate control system of claim 13, wherein the first parameter of the refrigerant fluid at the evaporator heat exchanger is a saturation temperature for the evaporator heat exchanger, and the second parameter of the refrigerant fluid at the condensing heat exchanger is a saturation temperature for the condensing heat exchanger.

20. The climate control system of claim 13, wherein the portion of refrigerant fluid routed through the bypass line is in a predominately liquid state at the upstream location on the main refrigerant circuit between the evaporator heat exchanger and the condensing heat exchanger.

* * * * *